US012391497B2

(12) United States Patent
Koyama

(10) Patent No.: US 12,391,497 B2
(45) Date of Patent: Aug. 19, 2025

(54) MEDIUM PLACING DEVICE AND RECORDING APPARATUS

(71) Applicant: SEIKO EPSON CORPORATION, Tokyo (JP)

(72) Inventor: Hiroki Koyama, Asahi-mura (JP)

(73) Assignee: SEIKO EPSON CORPORATION, Tokyo (JP)

( * ) Notice: Subject to any disclaimer, the term of this patent is extended or adjusted under 35 U.S.C. 154(b) by 238 days.

(21) Appl. No.: 18/047,802

(22) Filed: Oct. 19, 2022

(65) Prior Publication Data

US 2023/0122113 A1 Apr. 20, 2023

(30) Foreign Application Priority Data

Oct. 19, 2021 (JP) ..... 2021-170732

(51) Int. Cl.
*B65H 1/02* (2006.01)
*B65H 31/06* (2006.01)

(52) U.S. Cl.
CPC ..... *B65H 1/027* (2013.01); *B65H 31/06* (2013.01)

(58) Field of Classification Search
CPC ..... B65H 1/027; B65H 2403/411; B65H 2405/324; B65H 2407/21; B65H 31/20; B65H 9/101; B65H 2553/23
See application file for complete search history.

(56) References Cited

U.S. PATENT DOCUMENTS 4,579,333 A * 4/1986 Aoki ..... G03G 15/04 271/171
2015/0268028 A1* 9/2015 Hirota ..... G01B 7/02 324/207.17
2023/0081650 A1* 3/2023 Odani ..... B65H 7/04 271/152

FOREIGN PATENT DOCUMENTS

JP H04298442 A 10/1992
JP H05221534 A 8/1993
JP H07206173 A 8/1995
JP H07223758 A 8/1995
JP 2007191269 A * 8/2007 ..... B65H 1/04
JP 2015040093 A 3/2015
JP 2015078023 A 4/2015

OTHER PUBLICATIONS

Office Action for JP Patent Application No. 2021170732, issued on Feb. 4, 2025, 8 pages.

* cited by examiner

*Primary Examiner* — Howard J Sanders
(74) *Attorney, Agent, or Firm* — CHIP LAW GROUP

(57) ABSTRACT

A medium placing device (feeding tray) includes a placement unit, a regulation unit (edge guide), a displacement unit, a detection unit, and an adjustment unit. The regulation unit (edge guide) includes a first regulation member (first edge guide) and a second regulation member (second edge guide). The displacement unit is capable of moving the first regulation member (first edge guide) and the second regulation member (second edge guide) in directions opposite to each other along a first direction. The detection unit is provided between the placement unit and the adjustment unit.

15 Claims, 12 Drawing Sheets

MEDIUM PLACING DEVICE AND RECORDING APPARATUS

The present application is based on, and claims priority from JP Application Serial Number 2021-170732, filed Oct. 19, 2021, the disclosure of which is hereby incorporated by reference herein in its entirety.

BACKGROUND

1. Technical Field

The present disclosure relates to a medium placing device and a recording apparatus including the medium placing device.

2. Related Art

In the related art regarding a paper feeding device (corresponding to a medium placing device) included in a recording apparatus, JP-A-4-298442 discloses a configuration in which a holding means is movable in a vertical direction with respect to a paper-feeding direction of a sheet, the holding means for integrally holing a pinion and a rack that move a pair of regulating means in directions opposite to each other.

In JP-A-4-298442, when a sheet width is to be detected from a position of the regulating means in the paper feeding device, a sheet width detection mechanism is required to move integrally with the regulating means. However, JP-A-4-298442 does not describe arrangement of the sheet width detection mechanism and a position adjustment mechanism of the regulating means. Note that, with regard to the arrangement of the sheet width detection mechanism and the position adjustment mechanism of the regulating means, when the sheet width detection mechanism and the position adjustment mechanism merely overlap with each other, the paper feeding device is generally increased in size in a direction in which a sheet is stacked, which causes a problem.

SUMMARY

A medium placing device includes a placement unit at which a medium is placed, a regulation unit configured to regulate a movement of the medium placed on the placement unit in a first direction, a displacement unit configured to hold the regulation unit in a movable manner in the first direction, a detection unit configured to detect a position of the regulation unit in the first direction, and an adjustment unit configured to adjust positions of the regulation unit, the displacement unit, and the detection unit in the first direction, wherein the regulation unit includes a first regulation member configured to regulate a first edge of the medium in the first direction, and a second regulation member configured to regulate a second edge of the medium in the first direction, the second edge being opposite to the first edge, the displacement unit is configured to move the first regulation member and the second regulation member in directions opposite to each other along the first direction, and the detection unit is provided between the placement unit and the adjustment unit.

A recording apparatus includes the above-mentioned medium placing device and a recording unit configured to perform recording on the medium placed on the medium placing device.

DESCRIPTION OF EXEMPLARY EMBODIMENTS

1. Exemplary Embodiments

Figure 1:
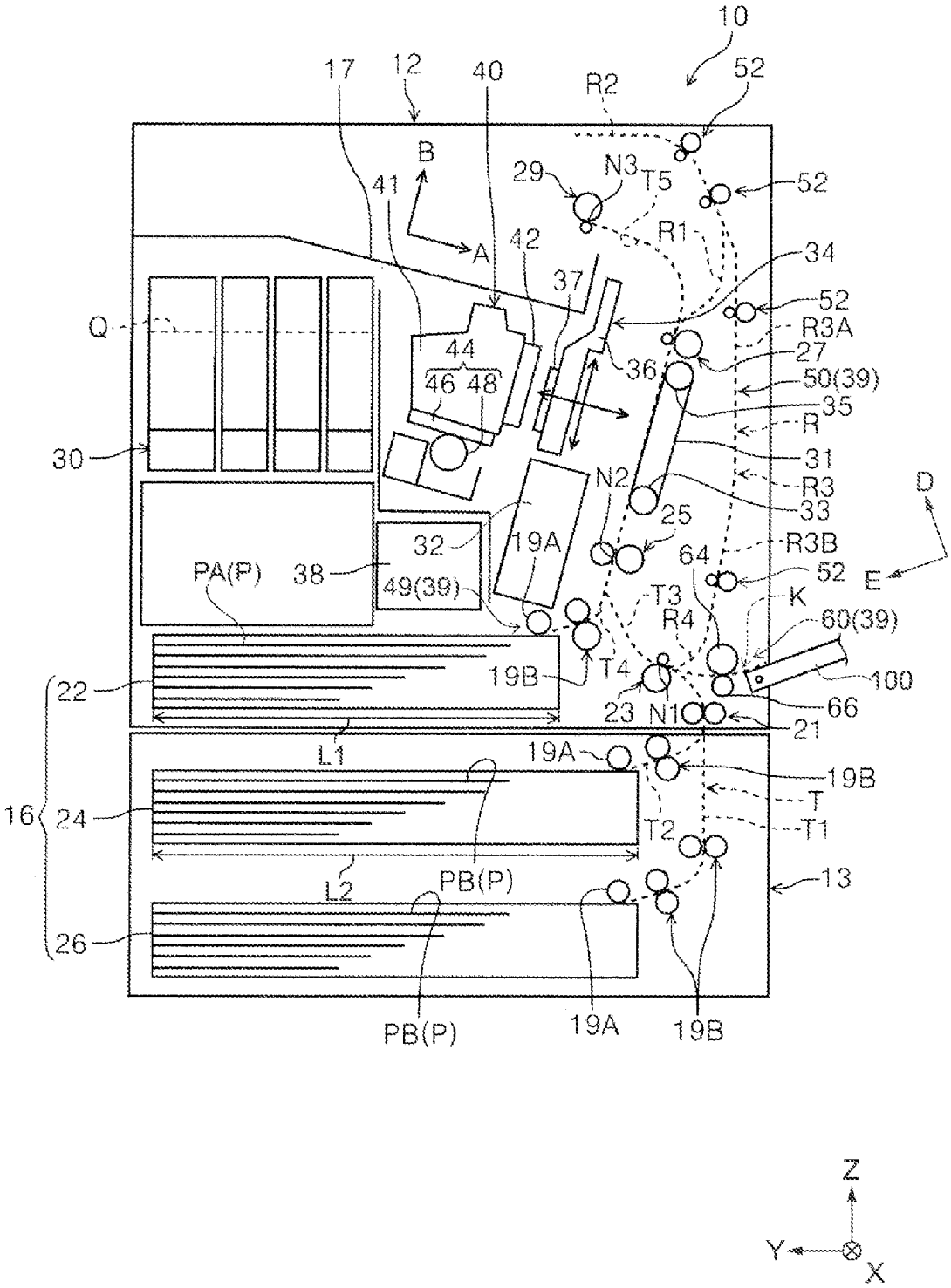
FIG. 1 is an internal configuration diagram of a recording apparatus according to the present exemplary embodiment.

FIG. 1 is an internal configuration diagram of a recording apparatus 10 according to the present exemplary embodiment.

With reference to FIG. 1, the configuration of the recording apparatus 10 is described.

As illustrated in FIG. 1, the recording apparatus 10 according to the present exemplary embodiment is a printer that forms an image by ejecting ink Q being a liquid onto a sheet P being a medium. Note that, an X-Y-Z coordinate system illustrated in each of the drawings is an orthogonal coordinate system.

A direction along an X-axis indicates a width direction of the recording apparatus 10, and a direction along a Y-axis indicates a depth direction of the recording apparatus 10. A direction along a Z-axis indicates a height direction of the recording apparatus 10. The direction along the X-axis is also a width direction of the sheet P.

A direction along an A-axis illustrated in FIG. 1 is a direction intersecting the direction along the Y-axis as viewed in a +X direction, and is an oblique direction in which a position in a −Y direction is inclined in a −Z direction with respect to a position in a +Y direction. A +A direction is a direction in which a line head 40 described later approaches a transporting belt 31. A −A direction is a direction in which the line head 40 retracts from the transporting belt 31. A direction along a B-axis illustrated in FIG. 1 is a direction intersecting the direction along the A-axis as viewed in the +X direction. A +B direction is a transport direction of the sheet P in a recording region between the line head 40 and the transporting belt 31.

In the recording apparatus 10, the sheet P is transported through a transport path T indicated with the broken line. Note that the transport direction in which the sheet P is transported is a direction along the transport path T, and hence differs in each part of the transport path T. A side to which the sheet P is transported is referred to as "downstream," and a side opposite thereto is referred to as "upstream" in some cases. Note that, in the recording apparatus 10, as examples of the sheet P, a sheet PA and a sheet PB that have different lengths in the transport direction may be used. The length of the sheet PA in the transport direction is shorter than the length of the sheet PB in the transport direction.

The recording apparatus 10 includes a main body unit 12 being an apparatus main body and an extension unit 13 arranged below the main body unit 12. Specifically, the recording apparatus 10 includes a sheet cassette 16, the line head 40 being a recording unit, and a transport unit 39. The transport unit 39 transports the sheet P, and includes a forward feeding unit 49, a reverse unit 50, and a feeding unit 60. In addition, the recording apparatus 10 includes an ink supply unit 30, a cap unit 32, a wiper unit 34, a waste liquid tank 38, and a control unit, which is not illustrated.

The main body unit 12 includes a casing being an exterior. A discharge tray 17 is provided at a part of the main body unit 12 in the +Z direction with respect to the center thereof in the direction along the Z-axis. The sheet cassette 16 is provided to the main body unit 12 and the extension unit 13.

The extension unit 13 includes a casing being an outline. The extension unit 13 is detachable from the main body unit 12. An upper end of the extension unit 13 in the +Z direction and a lower end of the main body unit 12 in the −Z direction are continuous. With this, the sheet P can be transported from the extension unit 13 to the main body unit 12.

The discharge tray 17 is a part from which the sheet P on which the line head 40 performs recording is discharged. The discharge tray 17 extends in the direction along the A-axis. In the discharge tray 17, edges of the plurality of placed sheets P in the +A direction are aligned along the +B direction.

The sheet cassette 16 is an accommodation unit that accommodates the sheet P. For example, the sheet cassette 16 includes a first cassette 22 that is provided to the main body unit 12 and a second cassette 24 and a third cassette 26 that are provided to the extension unit 13.

The first cassette 22 is formed into a rectangular-parallelepiped box-like shape that is opened in the +Z direction, and accommodates the sheet PA. When a pick-up roller 19A and a roller pair 19B rotate, the sheet P (PA) accommodated in the first cassette 22 is fed to the transport path T.

The second cassette 24 is positioned below the first cassette 22 in the direction along the Z-axis. The second cassette 24 is formed into a rectangular-parallelepiped box-like shape that is opened in the +Z direction, and accommodates the sheet PB. When the pick-up roller 19A and the roller pair 19B rotate, the sheet P (PB) accommodated in the second cassette 24 is fed to the transport path T via a path T2.

The third cassette 26 is positioned below the second cassette 24 in the direction along the Z-axis in the extension unit 13. Note that the third cassette 26 is configured similarly to the second cassette 24, and only arrangement thereof is different.

The ink supply unit 30 supplies the ink Q to the line head 40.

The cap unit 32 is formed into a box-like shape that is opened in the −A direction. The cap unit 32 is driven by a driving mechanism unit, which is not illustrated, and thus is reciprocally movable in the direction along the B-axis. When maintenance work is performed for the line head 40, the cap unit 32 moves in the +B direction and covers an ejection unit 42 described later, and thus the ink Q is sucked. When the line head 40 performs recording, the cap unit 32 retracts in a −B direction.

The wiper unit 34 includes a unit main body 36 capable of accommodating the ink Q and a wiper blade 37 that is provided to the unit main body 36 and that wipes off the ink Q adhering to the ejection unit 42. The wiper unit 34 is driven by a driving mechanism unit, which is not illustrated, and thus is reciprocally movable in the direction along the X-axis. When maintenance work is performed for the line head 40, the wiper unit 34 wipes the surface of the ejection unit 42 while moving in the +X direction. With this, the ink Q is collected. When the line head 40 performs recording, the wiper unit 34 retracts to a home position in the +X direction.

The waste liquid tank 38 is replaceably provided to the substantially central portion of the main body unit 12 in the direction along the Y-axis and the direction along the Z-axis. The waste liquid tank 38 accommodates the ink Q collected by the cap unit 32 and the ink Q collected by the wiper unit 34.

The control unit, which is not illustrated, is configured to include a Central Processing Unit (CPU), a Read Only Memory (ROM), a Random Access Memory (RAM), and a storage that are not illustrated, and controls transport of the sheet P and an operation of each of the portions including the line head 40 in the recording apparatus 10.

Under a state in which the line head 40 is positioned at the home position before an operation, the line head 40 is positioned above the sheet cassette 16 and the waste liquid tank 38 in the direction along the Z-axis. The line head 40 is one example of a recording unit that records an image or the like on the sheet P transported from the sheet cassette 16 along the transport path T described later. The line head 40 is driven by a moving mechanism unit 44 described later, and thus is movable in the +A direction and the −A direction. Specifically, the line head 40 includes a carriage 41 driven by the moving mechanism unit 44 and the ejection unit 42 supported by the carriage 41.

The ejection unit 42 ejects, onto the sheet P, the ink Q supplied from the ink supply unit 30.

The moving mechanism unit 44 in the present exemplary embodiment has a configuration including a rack portion 46, a pinion 48, and a motor, which is not illustrated. The rack portion 46 is mounted on a bottom portion of the carriage 41 in the −Z direction. The rack portion 46 includes a plurality of tooth portions, which are not illustrated. The pinion 48 is rotated by the motor in a forward direction or a reverse direction. A plurality of tooth portions, which are not illustrated, are formed on the outer peripheral portion of the pinion 48, and are meshed with the plurality of tooth portions of the rack portion 46.

The transport path T extends from the sheet cassette 16 to the discharge tray 17, and is a path in which the sheet P is transported. The forward feeding unit 49 is arranged in the transport path T. Specifically, the pick-up roller 19A, the roller pair 19B, a receiving roller pair 21, roller pairs 23 and 25, the transporting belt 31, a driving roller 33, a driven roller 35, a roller pair 27, and a discharge roller pair 29 are arranged. Each of the roller pairs is rotated about the axis in the direction along the X-axis. The driving roller 33 and the driven roller 35 are arranged at an interval therebetween in the direction along the B-axis, and are rotatable about the axis in the direction along the X-axis.

The receiving roller pair 21 is provided in a rotatable manner to the lower end of the main body unit 12 in the −Z direction. The receiving roller pair 21 receives the sheet P transported from the extension unit 13.

The transporting belt 31 is formed into a cylindrical shape, and is wound about the driving roller 33 and the driven roller 35. The transporting belt 31 is positioned in the +A direction with respect to the line head 40. When the driving roller 33 is rotated by a motor, which is not illustrated, the transporting belt 31 circularly moves. Under a state in which the sheet P is in contact with the outer peripheral surface of the transporting belt 31, the transporting belt 31 circularly moves. With this, the sheet P is transported in the +B direction.

Specifically, the transport path T includes a path T1, the path T2, a path T3, a path T4, and a path T5. The path T1 extends from a position corresponding to the end of the third cassette 26 in the −Y direction to a nip center position N1 of the roller pair 23. The path T2 extends from a position corresponding to the end of the second cassette 24 in the −Y direction, and merges with the path T1 at a position upstream of the receiving roller pair 21.

The path T3 extends from the nip center position N1 to a nip center position N2 of the roller pair 25. The path T4 extends from a position corresponding to the end of the first cassette 22 in the −Y direction, and merges with the path T3. The path T5 extends from the nip center position N2 to a nip center position N3 of the discharge roller pair 29 via the transporting belt 31 and the roller pair 27.

The reverse unit 50 includes a reverse path R, four roller pairs 52, and a motor, which is not illustrated. Further, the reverse unit 50 reverses the sides of the sheet P on which the line head 40 performs recording, and then feeds the sheet P to the transport path T again. The reverse path R is a path that includes a curve path R4 and is coupled to an upstream part and a downstream part of the transport path T with respect to the line head 40. The reverse path R includes a branch path R1, a switch back path R2, an upstream path R3, and the curve path R4. The branch path R1 is branched from the path T5 at a position in the +Z direction with respect to the roller pair 27, and extends to a position in the −Y direction and the +Z direction. The switch back path R2 extends from the end of the branch path R1 in the +Z direction to a position in the +Y direction and the +Z direction.

The upstream path R3 is positioned upstream of the curve path R4, which is described later, and downstream of the switch back path R2 in the transport direction of the sheet P. The upstream path R3 includes a vertical path part R3A and an inclined part R3B. The vertical path part R3A extends linearly in the −Z direction from a merging position of the branch path R1 and the switch back path R2.

The curve path R4 is positioned downstream of the upstream path R3 in the transport direction of the sheet P. Specifically, the upstream end of the curve path R4 is continuous with the lower end of the inclined part R3B in the −Z direction. The curve path R4 is a path that is curved to be convex in the −Z direction as viewed in the +X direction. The curve path R4 merges with the path T3 at the nip center position N1 of the roller pair 23. The roller pair 23 is one example of a transport roller pair provided in the curve path R4. The roller pair 23 transports the sheet P along with rotation.

The feeding unit 60 includes a feeding tray 100 being a medium placing device, a feeding roller 64, and a separating roller 66. The feeding unit 60 includes a feeding path K in which the feeding roller 64 and the separating roller 66 are arranged. Further, the feeding unit 60 feeds the sheet P from the feeding tray 100 to the transport path T via the feeding path K.

The feeding path K is a path that extends from the feeding tray 100 to the transport path T, is coupled to the upstream part of the transport path T with respect to the line head 40, and allows transport of the sheet P.

The feeding tray 100 in configured so that a plurality of sheets P can be placed thereon. The feeding roller 64 is arranged downstream of the feeding tray 100 in a feeding direction in which the sheet P is fed in the feeding path K, and is arranged above the feeding path K. The feeding roller 64 is rotated by a motor, which is not illustrated, and thus feeds the sheet P to the transport path T while being rotated.

The separating roller 66 is arranged downstream of the feeding tray 100 in a feeding direction in which the sheet P is fed in the feeding path K, and is arranged below the feeding path K. The separating roller 66 has a predetermined load in a rotation direction in which the sheet P is fed. With this, one sheet P is separated from the plurality of sheets P placed on the feeding tray 100, and is fed. Note that a lift-up mechanism unit, which is not illustrated, for pushing the sheet P upward is provided between the feeding tray 100 and the separating roller 66.

Figure 2:
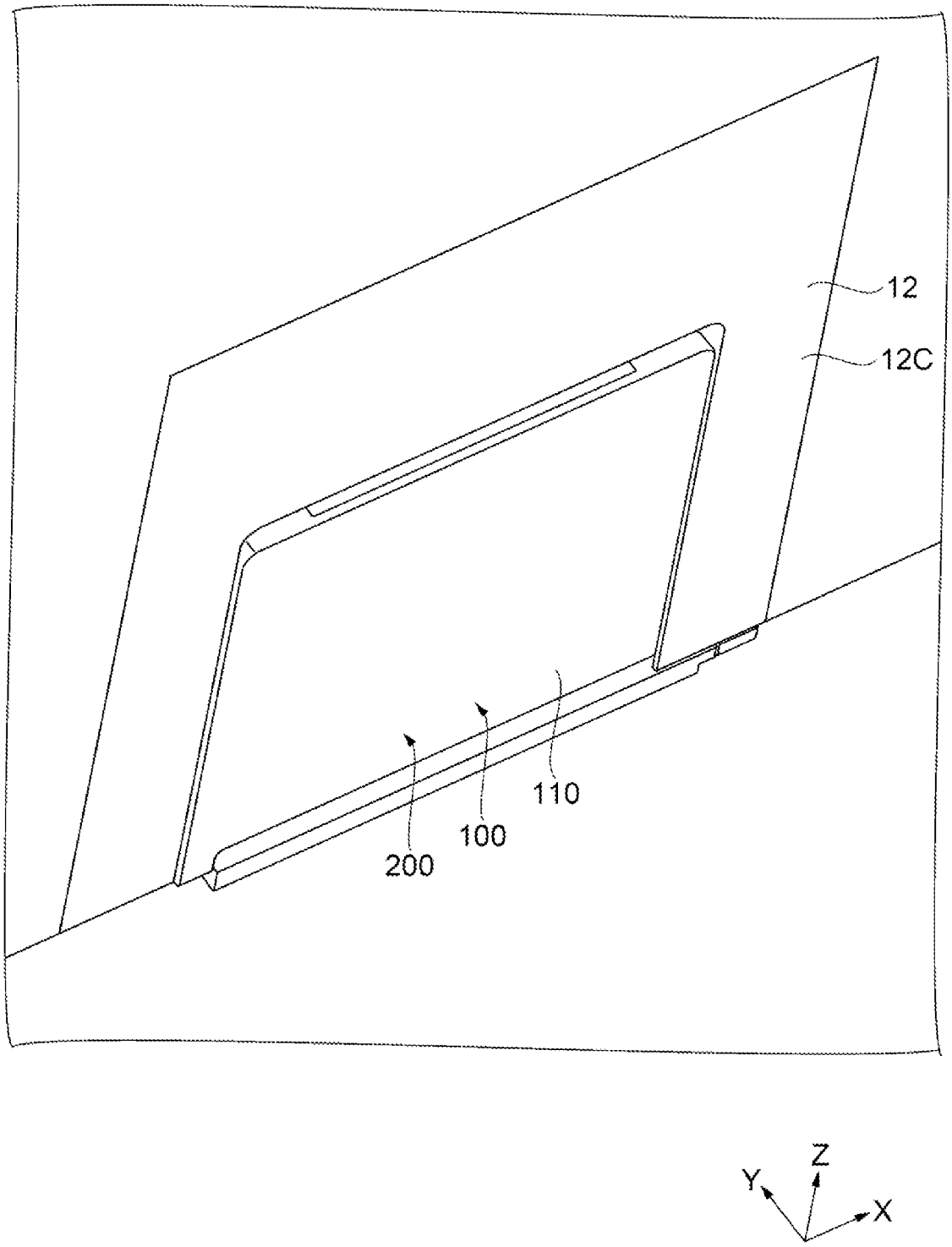
FIG. 2 is a perspective view illustrating a closed state of a feeding tray.
Figure 3:
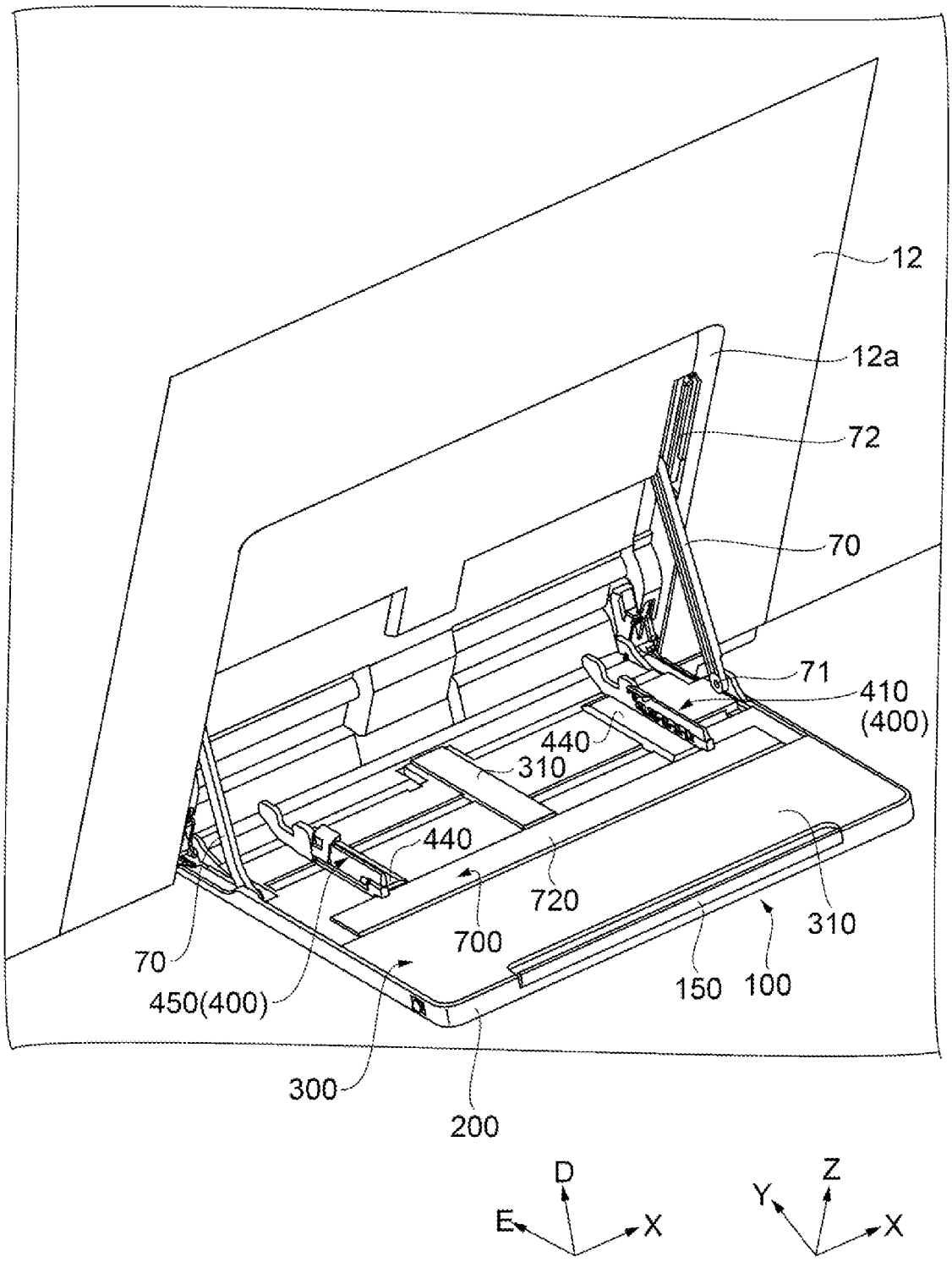
FIG. 3 is a perspective view illustrating an opened state of the feeding tray.
Figure 4:
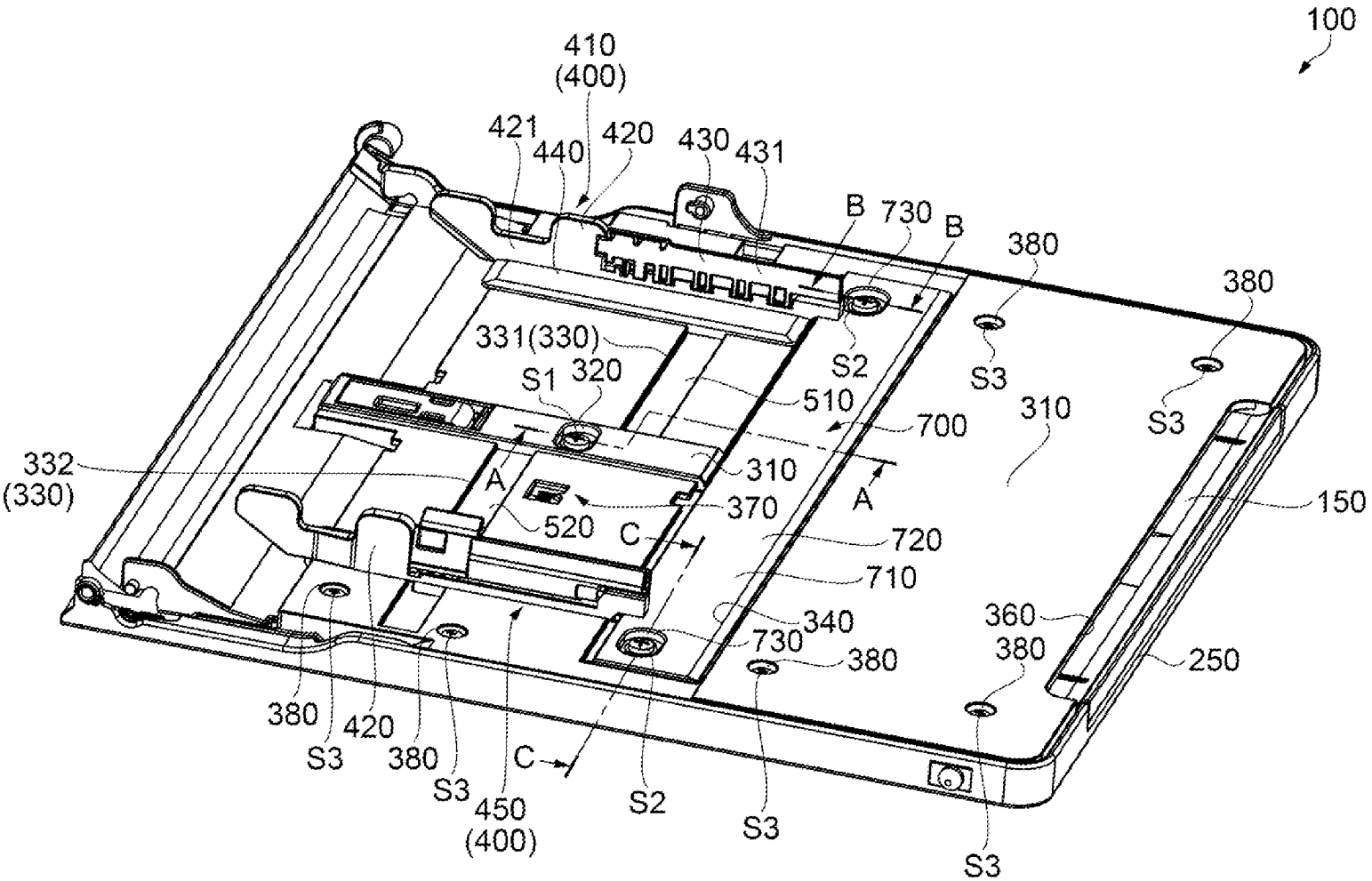
FIG. 4 is a perspective view of the feeding tray.

FIG. 2 is a perspective view illustrating a closed state of the feeding tray 100. FIG. 3 is a perspective view illustrating an opened state of the feeding tray 100. FIG. 3 illustrates a diagram in which a screw for fixing each configuration component of the feeding tray 100, a hole portion for inserting a screw, and the like, are omitted. FIG. 4 is a perspective view of the feeding tray 100.

A configuration of the feeding tray 100 is described.

As illustrated in FIG. 2 and FIG. 3, the feeding tray 100 is provided so as to be displaceable between an opened state and a closed state with respect to the main body unit 12. Note that, in the present exemplary embodiment, the opened state of the feeding tray 100 is referred to as a used state, hereafter. In the present exemplary embodiment, the closed state of the feeding tray 100 is referred to as an accommodated state, hereafter. The feeding tray 100 according to the present exemplary embodiment is arranged on the side surface of the main body unit 12 in the −Y direction at a lower part with respect to the center in the direction along the Z-axis.

As illustrated in FIG. 2, when the feeding tray 100 is in the accommodated state, the feeding tray 100 is accommodated in the main body unit 12. When the feeding tray 100 is in the accommodated state, the sheet P cannot be placed thereon, which corresponds to a non-used state in which the feeding tray 100 is not used. As illustrated in FIG. 3, when the feeding tray 100 is in the used state, the feeding tray 100 is inclined with respect to the main body unit 12. Thus in the used state, the plurality of sheets P can be placed thereon.

After FIG. 3, for convenience of the description, a normal line direction of a placement surface 310 of the feeding tray 100, which is described later, is regarded as a D direction (the arrow direction indicates a +D direction), and a direction in which the sheet P placed on the placement surface 310 is fed toward the main body unit 12 along the placement surface 310 is regarded as an E direction (the arrow direction indicates a +E direction). Thus, an orthogonal coordinate system indicated with D-E-X is newly given in illustration. Note that a direction opposite to the +E direction is regarded as the −E direction. A direction opposite to the +D direction is regarded as the −D direction. The +D direction is a direction in which the sheet P is stacked, and corresponds to a height direction and a thickness direction on the feeding tray 100.

As illustrated in FIG. 3 and FIG. 4, the feeding tray 100 is generally formed into a plate-like shape, and hence the plurality of sheets P can be placed on the placement surface 310 of a placement unit 300 provided on a tray main body 200. The placement surface 310 is formed into a substantially flat surface. As described later, placement surfaces 440 and 720 configured in other configuration units are also formed into substantially flat surfaces similar to the placement surface 310, are formed as substantially continuous flat surfaces (flush surfaces), in other words, as substantially even horizontal surfaces, and allow placement of the plurality of sheets P together with the placement surface 310. The tray main body 200 is formed into a rectangular shape in plan view from the +D direction.

In the main body unit 12, a recess portion 12*a* recessed in an inward direction of the main body unit 12 is formed. When the feeding tray 100 is in the accommodated state (FIG. 2), an outer surface 12*c* of the main body unit 12 and an outer surface 110 of the feeding tray 100 are formed as substantially continuous flat surfaces (flush surfaces).

The feeding tray 100 is configured to be openable and closable about a rotational movement shaft along the X-axis being a width direction between the accommodated state (FIG. 2) and the used state (FIG. 3). An end of the tray main body 200 in the −X direction and an end thereof in the +X direction is provided with a rod-like ling member 70 for coupling the feeding tray 100 and the main body unit 12. One end of the link member 70, which is coupled to the tray main body 200, is coupled in a pivotable manner with the tray main body 200 about a rotational movement shaft 71 parallel to the X-axis. The other end of the link member 70, which is coupled to the main body unit 12, is engaged with a guide rail 72 provided to the main body unit 12.

The guide rail 72 extends in the direction along the Z-axis, and the other end of the link member 70 moves along the guide rail 72. Furthermore, the other end of the link member 70 abuts against the lower end of the guide rail 72, and thus the position of the feeding tray 100 in the used state is regulated. In other words, in the used state, the link member 70 regulates an opening angle of the feeding tray 100 with respect to the main body unit 12.

Figure 5:
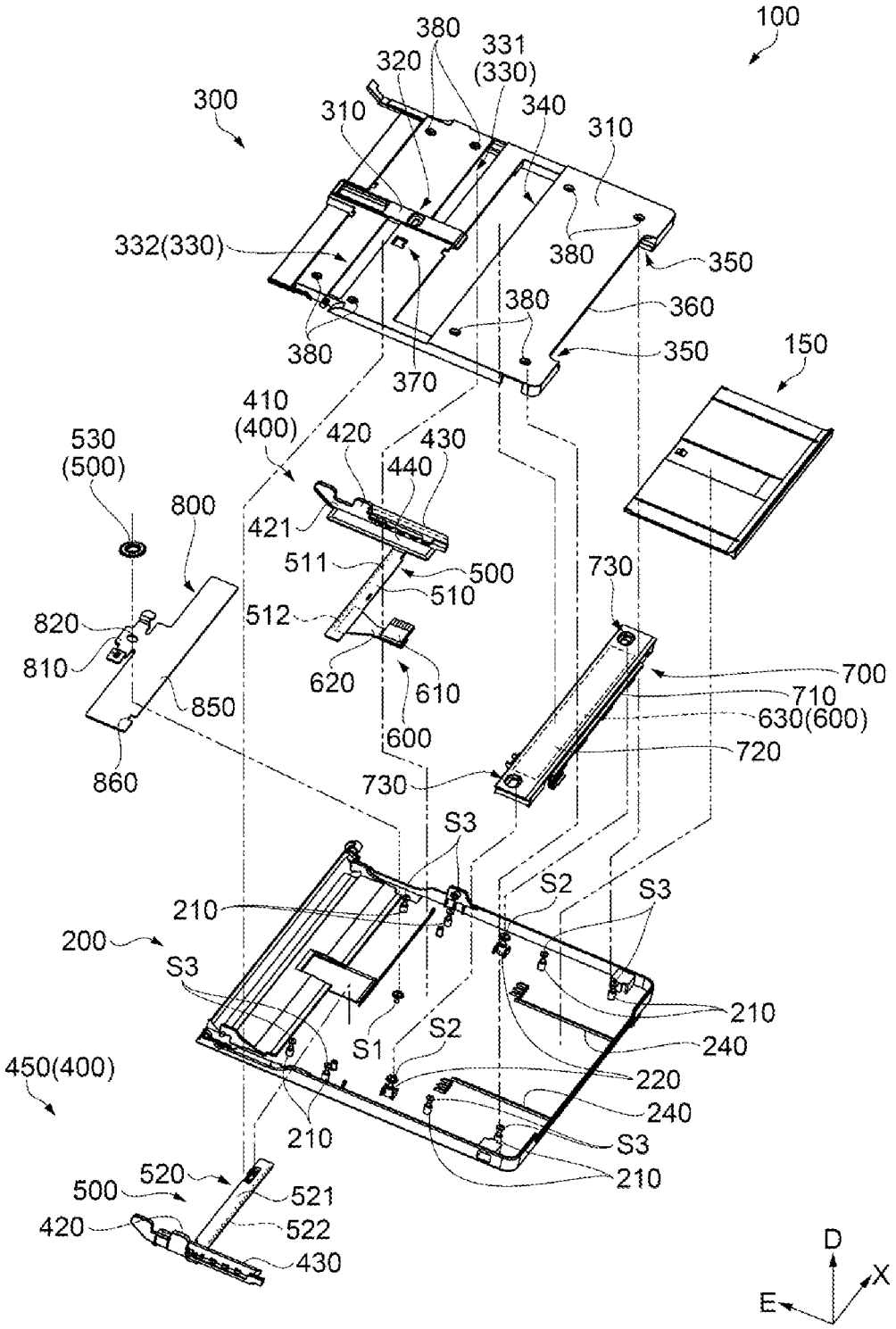
FIG. 5 is an exploded perspective view of the feeding tray.

FIG. 5 is an exploded perspective view of the feeding tray 100. Note that FIG. 5 is an exploded perspective view of main configuration units of the feeding tray 100.

With reference to FIG. 4 and FIG. 5, the configuration of the feeding tray 100 is described.

As illustrated in FIG. 4 and FIG. 5, the feeding tray 100 is generally configured to include the tray main body 200, the placement unit 300, an edge guide 400 being a regulation unit, a displacement unit 500, a detection unit 600, a detection holding unit 700, and an adjustment unit 800.

The tray main body 200 functions as an exterior of the feeding tray 100 and a base member that receives the respective configuration units.

The placement unit 300 functions as a frame for placing the sheet P being a medium and providing each of the configuration units at a predetermined portion.

The edge guide 400 regulates movement of the sheet P, which is placed on the placement unit 300, in a first direction. Note that, in the present exemplary embodiment, the first direction is the width direction of the sheet P, and corresponds to the X direction.

The displacement unit 500 is a configuration unit that holds the edge guide 400 in a movable manner in the first direction. The detection unit 600 is a configuration unit that detects a position of the edge guide 400 in the first direction.

The detection holding unit 700 is a configuration unit that holds the detection unit 600.

The adjustment unit 800 is a configuration unit capable of adjusting positions of the edge guide 400, the displacement unit 500, and the detection unit 600 in the first direction.

An outline of an assembly of the feeding tray 100 is described.

First, the adjustment unit 800 is provided at a predetermined position on an inner surface of the tray main body 200 using the tray main body 200 as a base member. The adjustment unit 800 is formed of a pinion holding portion 810 and a fixing portion 850 for the detection unit, which are continuous in a plate-like shape. Note that the pinion holding portion 810 holds a pinion 530 of the displacement unit 500 via a fixing pin 820 provided by crimping. Specifically, the pinion holding portion 810 guides the pinion 530 in a slidable manner to the outer peripheral of the fixing pin 820, and holds the pinion 530 in a freely pivotable manner. The fixing portion 850 for the detection unit fixes a printed wired board 630 being a position detection portion of the detection unit 600.

Next, the placement unit 300 is provided using the tray main body 200 as a base member. With a reference position, which is not illustrated, formed in the tray main body 200 as a reference, the placement unit 300 is provided on the inner surface of the tray main body 200.

Note that, when the placement unit 300 is provided on the tray main body 200, both ends of the extension member 150 in the X direction are engaged with an opening portion 360 for the extension member, which is formed at the end of the placement unit 300 in the −E direction, and an accommodation portion 350 for the extension member, which is formed on the inner surface side along the +E direction from both the ends of the opening portion 360 for the extension member in the X direction. With this, the extension member 150 is accommodated. Furthermore, the placement unit 300 in this state is provided on the tray main body 200. When the placement unit 300 accommodating the extension member 150 is provided on the tray main body 200, the lower surface of the extension member 150 is guided to a rib 240 of the tray main body 200 for guiding the extension member, slides along the accommodation portion 350 for the extension member, and thus can extend in the −E direction from the opening portion 360 for the extension member and an opening portion 250 for the extension member, which is formed in the tray main body 200.

When, in the used state of the feeding tray 100, the extension member 150 accommodated in the tray main body 200 and the placement unit 300 is drawn out and extended in the −E direction, the sheet P can be supported in a stable state in accordance with a size of the sheet P to be placed. When, in the accommodated state of the feeding tray 100, the extension member 150 is contracted in the +E direction and accommodated in the tray main body 200 and the placement unit 300, the feeding tray 100 and the recording apparatus 10 can be reduced in size.

When the placement unit 300 is provided on the tray main body 200, a plurality of fixing screw hole portions 380 formed in the placement unit 300 are positioned on an upper surface of dowels 210 for fixing the placement unit, which are correspondingly formed on the tray main body 200. When the placement unit 300 is provided on the tray main body 200, a screw hole portion 320 for fixing the adjustment unit, which is formed in the placement unit 300, is positioned on the upper surface of the fixing pin 820 of the adjustment unit 800.

Next, the edge guides 400 are provided on the tray main body 200 and the placement unit 300.

A configuration of the edge guides 400 is described below.

The edge guides 400 include a first edge guide 410 and a second edge guide 450. The first edge guide 410 is a first regulation member that regulates a first edge of the sheet P in the first direction, and the second edge guide 450 is a second regulation member that regulates a second edge of the sheet P in the first direction, which is opposite to the first edge. Note that the first edge of the sheet P in the first direction is an end surface (side surface) of the sheet P in the +X direction. The second edge of the sheet P in the first direction, which is opposite to the first edge, is an end surface (side surface) of the sheet P in the −X direction.

The first edge guide 410 and the second edge guide 450 are configured to be substantially symmetric to each other with respect to the transport direction (the +E direction). The edge guides 400 (the first edge guide 410 and the second edge guide 450) are plate-like members, and are arranged to extend along the transport direction of the sheet P (the +E direction). The edge guides 400 are provided at the −X side and the +X side of the tray main body 200, and interlock with the displacement unit 500 (the pinion 530, a first rack portion 510, and a second rack portion 520 that are described later). Thus, the edge guides 400 are movable in the opposite directions along the direction along the X-axis. The pair of edge guides 400 (the first edge guide 410 and the second edge guide 450) move in the opposite directions so as to correspond to various sizes of the placed sheet P in the width direction.

The first edge guide 410 and the second edge guide 450 are configured in a substantially similar manner. Thus, a configuration of the first edge guide 410 provided in the +X direction is described, and the second edge guide 450 is described while focusing on a difference between the configurations.

The first edge guide 410 includes a fixing portion 420, a movable portion 430, and the placement surface 440. The movable portion 430 has a plate-like shape, and is configured to be pivotable between a posture of laying down in the +X direction along the placement surface 440 in the accommodated state and a posture of standing up with respect to the placement surface 440 in the used state (FIG. 3 and FIG. 5). A flat surface 431 is provided to the movable portion 430 in the −X direction in the used state. The flat surface 431 is a surface substantially vertical to the placement surface 440. The side surface (the first edge) of the sheet P in the width direction can be regulated by the flat surface 431.

The fixing portion 420 has a plate-like shape, and is fixed at a posture of standing up with respect to the placement surface 440. The fixing portion 420 is a portion that is brought into contact with a hand of a user at the time of moving the first edge guide 410 in the direction along the X-axis. A flat surface 421 is provided to the fixing portion 420 in the −X direction. The flat surface 421 is a surface substantially vertical to the placement surface 440. The flat surface 421 regulates the side surface (the first edge) of the sheet P in the width direction. In other words, the flat surface 421 of the fixing portion 420 and the flat surface 431 of the movable portion 430 are formed continuously with each other along the transport direction of the sheet P, and the flat surface 421 and the flat surface 431 regulate the side surface (the first edge) of the sheet P in the width direction.

The first rack portion 510 is formed at the first edge guide 410, and extends from the placement surface 440 in the −X direction on the lower side of the placement surface 440. The first rack portion 510 forms the displacement unit 500, and includes a first flat plate portion 511 and a first rack 512. The first flat plate portion 511 has a flat plate-like shape extending in the −X direction, and the first rack 512 is formed along the edge end of the first flat plate portion 511 in the +E direction (along the X direction) on the lower side (on the back surface side) of the first flat plate portion 511.

A plate metal holding portion 620 extending in the −E direction is fixed to the lower side of the first flat plate portion 511 in the −D direction. Note that the first flat plate portion 511 and the plate metal holding portion 620 may be integrally formed. The plate metal holding portion 620 forms the detection unit 600, and a plate metal 610 being a detected portion is fixed to the upper surface of the edge end of the plate metal holding portion 620 in the −E direction.

The second edge guide 450 is provided with the second rack portion 520 correspondingly to the first rack portion 510 of the first edge guide 410, and the second rack portion 520 is provided with a second flat plate portion 521 and a second rack 522 correspondingly to the first flat plate portion 511 and the first rack 512. The second rack portion 520 forms the displacement unit 500 in a similar manner to the first rack portion 510.

The first edge guide 410 thus configured is inserted or the like inside through a first opening portion 331 of an opening portion 330 for the regulation unit, which is formed in the placement unit 300, and thus is provided in the tray main body 200. Note that, as another installation method, the first edge guide 410 may be divided into a configuration unit provided in the upper direction (the +D direction) with respect to the placement unit 300 and a configuration unit provided inside the placement unit 300, while regarding the placement unit 300 as a reference, and thus may be provided on the tray main body 200. In a similar manner to the first edge guide 410, the second edge guide 450 is also inserted or the like inside through a second opening portion 332 of the opening portion 330 for the regulation unit, which is formed in the placement unit 300, and thus is provided in the tray main body 200. The second edge guide 450 may be divided into a configuration unit provided in the upper direction (the +D direction) with respect to the placement unit 300 and a configuration unit provided inside the placement unit 300, while regarding the placement unit 300 as a reference, and thus may be provided on the tray main body 200.

The edge guide 400 is provided, and thus the pinion 530 of the displacement unit 500 is meshed with the second rack 522 of the displacement unit 500 provided to the second edge guide 450 in the +E direction. The pinion 530 is meshed with the first rack 512 of the displacement unit 500 provided to the first edge guide 410 in the −E direction. Note that, as the displacement unit 500 in the present exemplary embodiment, a so-called rack pinion mechanism is used, and has a configuration in which both the racks move with respect to the center in the opposite directions with the pinion as a center. With this assembly, the displacement unit 500 is configured.

When the first edge guide 410 and the placement unit 300 are assembled in the tray main body 200, the plate metal holding portion 620 and the plate metal 610 of the detection unit 600 are exposed through the opening portion 340 for the detection unit, which is formed in the placement unit 300. A fixing cutout portion 860 formed in the fixing portion 850 for the detection unit, which is provided to the initially provided adjustment unit 800 is exposed through the opening portion 340 for the detection unit.

Next, the detection holding unit 700 is provided on the tray main body 200 on which the placement unit 300 is provided. A configuration of the detection holding unit 700 is described below.

The detection holding unit 700 is a member that holds the printed wired board 630 being a position detection portion of the detection unit 600. The detection holding unit 700 has a rectangular plate-like shape extending in the X direction, and includes a holding unit main body 710 that is formed to be opened in the −D direction. One screw hole portion 730 for holding the detection unit is formed in each of the edge ends of the holding unit main body 710 in the X direction.

The printed wired board 630 is held on the inner peripheral surface of the holding unit main body 710 in the −D direction under a state in which both the ends thereof in the X direction are sandwiched between the screw hole portions 730 for holding the detection unit. Note that a circuit pattern is formed on the surface of the printed wired board 630 in the −D direction so as to detect a size of the sheet P in the width direction. A plate member 750 (FIG. 6) having a protrusion portion 751 (FIG. 6) protruding in the −D direction is provided on the inner peripheral surface of the holding unit main body 710.

The detection holding unit 700 thus configured is inserted from above through the opening portion 340 for the detection unit, which is formed in the placement unit 300. When the detection holding unit 700 is inserted through the opening portion 340 for the detection unit, the plate metal 610 being a detected portion abuts against the circuit pattern of the printed wired board 630 being a position detection portion.

Note that, when the first edge guide 410 is provided, the plate metal 610 is provided so as to be positioned at a set initial position. Furthermore, when the detection holding unit 700 is inserted through the opening portion 340 for the detection unit, the plate metal 610 is positioned at the initial position that is set on the printed wired board 630. When the detection holding unit 700 is inserted through the opening portion 340 for the detection unit, the protrusion portion 751 of the detection holding unit 700 is engaged with the fixing cutout portion 860.

When the main configuration units are assembled to the tray main body 200 as described above, screws S3 are finally inserted through the plurality of fixing screw hole portions 380 of the placement unit 300, and are threaded with the dowels 210 for fixing the placement unit. With this, the placement unit 300 is fixed to the tray main body 200. The screw S1 is inserted through the screw hole portion 320 for fixing the adjustment unit, which is formed in the placement unit 300, and is threaded with the fixing pin 820 of the adjustment unit 800. With this, the adjustment unit 800 is fixed with respect to the placement unit 300.

Screws S2 are inserted through the screw hole portions 730 for holding the detection unit, which are formed in the detection holding unit 700 (the holding unit main body 710), and are threaded with dowels 220 for holding the detection unit. With this, the tray main body 200 holds the detection holding unit 700. Note that, when the detection holding unit 700 is threaded with the dowels 220 for holding the detection unit by using the screws S2, the top surfaces of the dowels 220 for holding the detection unit protrude upward with respect to a holding portion 731 of the detection holding unit 700, which is sandwiched between the screws S2. The holding portion 731 is described later. Thus, when the screws S2 are threaded, the holding portion 731 is not fixed by abutting against the top surfaces of the dowels 220 for holding the detection unit.

When the detection holding unit 700 (the holding unit main body 710) is provided on the tray main body 200, an upper surface being an external surface of the holding unit main body 710 forms the placement surface 720 on which the sheet P is placed, together with the placement surface 310 of the placement unit 300. Note that the placement surface 720 corresponds to a first surface of the detection holding unit 700.

The respective configuration units are assembled as described above. With this, the feeding tray 100 is completed.

The functions and operations of each of the configuration units in the present exemplary embodiment are described below.

In the drawings given hereinafter, it is assumed that the respective configuration units of the feeding tray 100 are assembled, and functions and operations of each of the configuration units are described. Thus, for convenience, a relevant configuration unit is extracted in illustration, and an irrelevant configuration unit is omitted in illustration in some cases.

Figure 6:
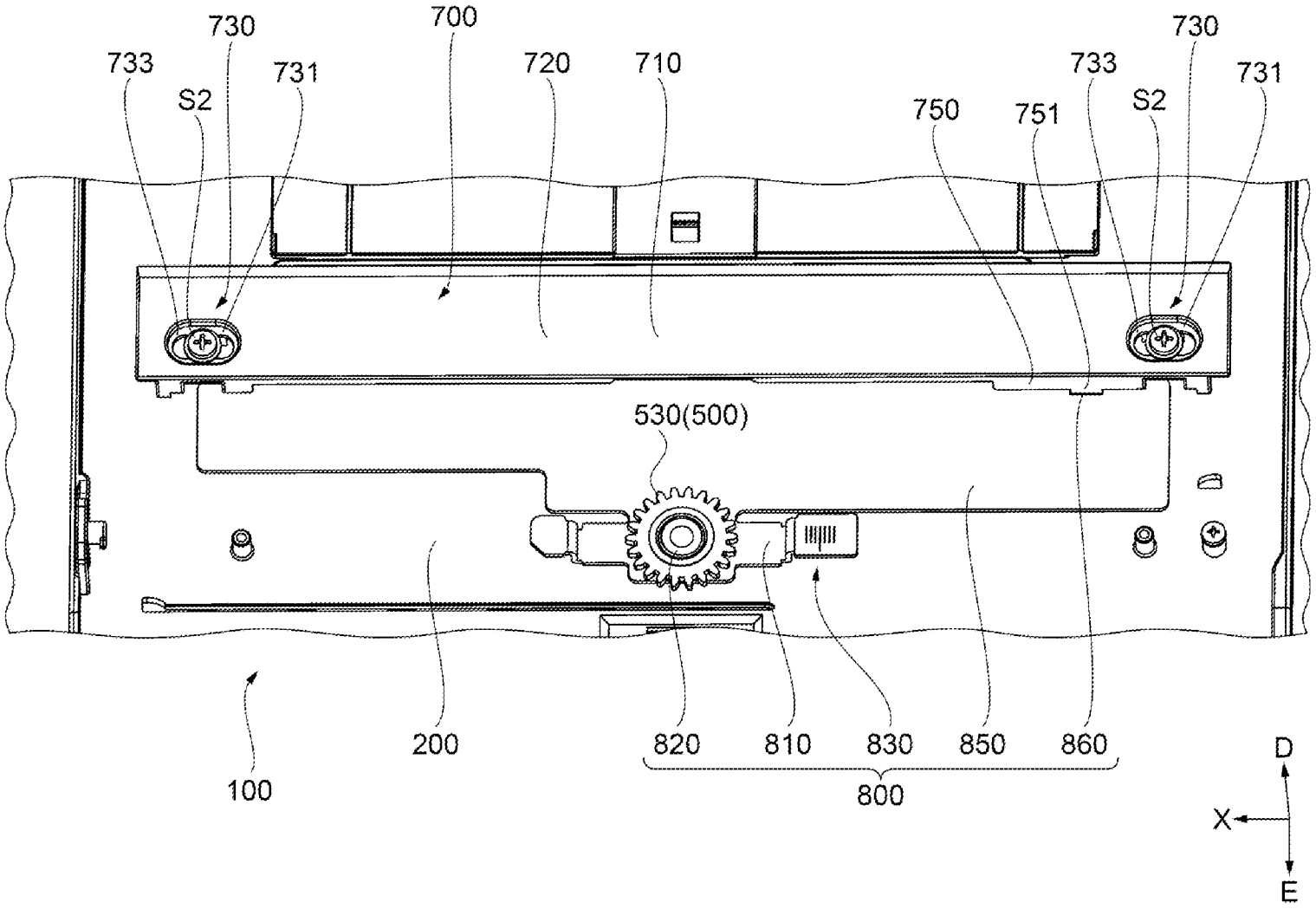
FIG. 6 is a perspective view illustrating an adjustment unit, a displacement unit, and a detection holding unit that are provided on a tray main body.

FIG. 6 is a perspective view illustrating the adjustment unit 800 (the pinion holding portion 810 and the fixing portion 850 for the detection unit), the displacement unit 500 (the pinion 530), and the detection holding unit 700 (the holding unit main body 710 and the plate member 750) that are provided on the tray main body 200. FIG. 6 is a perspective view as viewed obliquely from above.

As illustrated in FIG. 6, the pinion 530 is guided to the outer periphery of the fixing pin 820 of the pinion holding portion 810 in a freely pivotable manner. The protrusion portion 751 formed on the plate member 750 of the detection holding unit 700 is inserted from above and engaged with the fixing cutout portion 860 of the fixing portion 850 for the detection unit. The protrusion portion 751 is engaged with the fixing cutout portion 860. With this, the fixing portion 850 for the detection unit, which is provided to the adjustment unit 800, and the detection holding unit 700, which holds the printed wired board 630 of the detection unit 600, are fixed to each other. Furthermore, when the fixing portion 850 for the detection unit moves in the X direction, the detection holding unit 700 also moves in the X direction in an interlocking manner.

In other words, the adjustment unit 800 (the fixing cutout portion 860 of the fixing portion 850 for the detection unit) is engaged with the detection holding unit 700 (the protrusion portion 751), and the detection holding unit 700 interlocks with an operation of the adjustment unit 800. Note that a configuration in which the detection holding unit 700 moves in the X direction in interlocking with the adjustment unit 800 is described below in detail.

Figure 7:
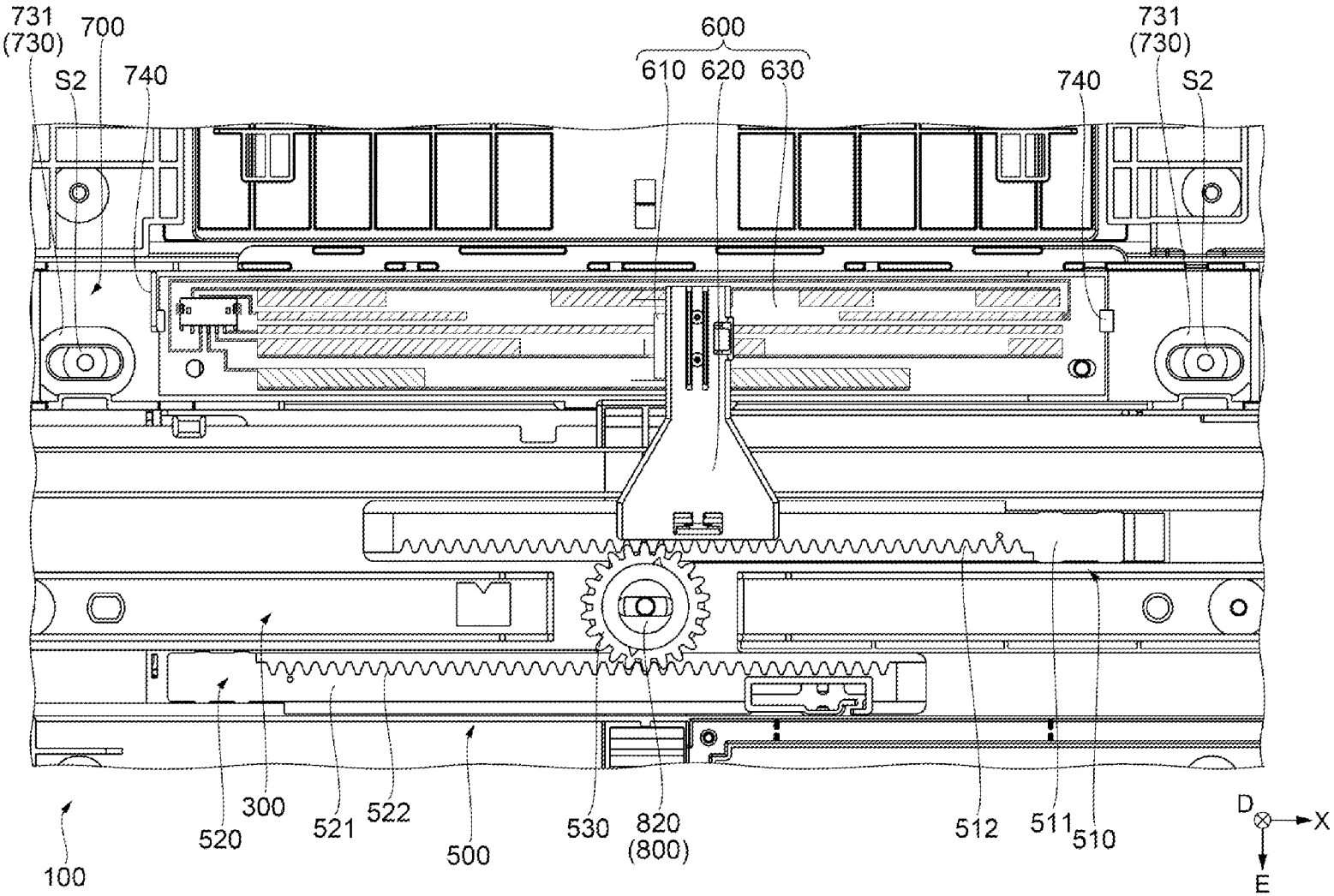
FIG. 7 is a plan view illustrating the adjustment unit, the displacement unit, a detection unit, and the detection holding unit.
Figure 8:
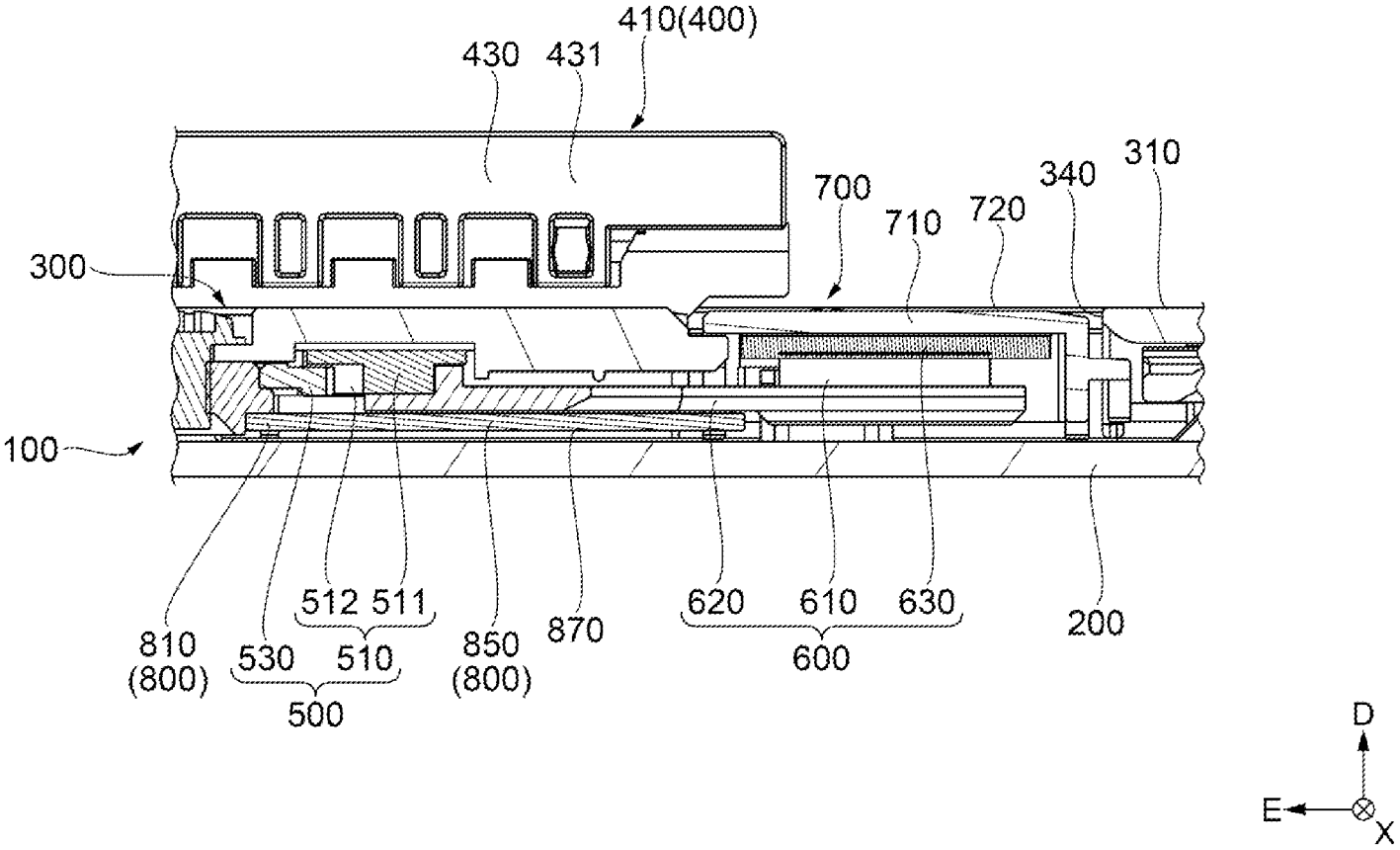
FIG. 8 is a cross-sectional view illustrating the detection unit, the displacement unit, a placement unit, and the adjustment unit.

FIG. 7 is a plan view illustrating the adjustment unit 800, the displacement unit 500, the detection unit 600, and the detection holding unit 700. Note that FIG. 7 is a plan view as viewed from below. FIG. 8 is a cross-sectional view illustrating the detection unit 600 (the plate metal 610, and the printed wired board 630), the displacement unit 500 (the pinion 530 and the first rack 512), the placement unit 300 (the placement surface 310, the opening portion 340 for the detection unit), and the adjustment unit 800 (the pinion holding portion 810, the fixing portion 850 for the detection unit). FIG. 8 is a cross-sectional view taken along the line A-A in FIG. 4.

As illustrated in FIG. 7 and FIG. 8, with the pinion 530 guided to the outer periphery of the fixing pin 820 in a freely pivotable manner, the first rack 512 of the first rack portion 510, which extends in the X direction, is meshed in the −E direction, and the second rack 522 of the second rack portion 520, which extends in the X direction, is meshed in the +E direction. Thus, for example, when a user grips the fixing portion 420 of the first edge guide 410, and moves the first edge guide 410 in the direction along the X-axis, the second edge guide 450 moves accordingly in a direction opposite to the first edge guide 410 via the pinion 530.

In other words, the displacement unit 500 (the first rack 512, the second rack 522, and the pinion 530) moves the first regulation member (the first edge guide 410) and the second regulation member (the second edge guide 450) in the directions opposite to each other along the first direction (the width direction of the sheet P: the X direction).

The plate metal 610 that is held by the plate metal holding portion 620 fixed to the lower surface of the first flat plate portion 511 is positioned at the lower surface of the printed wired board 630 held by the holding unit main body 710. Note that the printed wired board 630 is fixed by a hooking structure using elastic deformation of a board fixing portion 740 that is formed to protrude downward of the holding unit main body 710.

A plurality of circuit patterns corresponding to sheet sizes are formed on the printed wired board 630 so as to detect a size of the sheet P in the width direction (for example, A4 size or B5 size). Note that the circuit patterns are formed on the lower surface of the printed wired board 630. The plate metal 610 (specifically, a plurality of abutting terminals of the plate metal 610) abuts against the circuit patterns from below so as to traverse in the E direction, and thus the printed wired board 630 is short-circuited.

Note that the plate metal 610 moves in the X direction in interlocking with the first edge guide 410. With this, the position of the abutting terminal that abuts against the circuit patterns moves while sliding, and is brought into contact with different positions of the circuit patterns (short-circuit). Furthermore, based on a combination of the circuit patterns that are short-circuited in the traverse direction (the E direction) and are read by a sensor or the like, which is not illustrated, the sheet size is detected. Note that, when the sheet size is detected, it can also be said that the printed wired board 630 being a position detection portion detects a position of the plate metal 610 being a detected portion in the width direction of the sheet P.

As illustrated in FIG. 8, the detection unit 600 (the plate metal 610 and the printed wired board 630) are provided between the placement unit 300 (specifically, the placement surface 310 being an upper surface of the placement unit 300) and the adjustment unit 800 (specifically, the pinion holding portion 810 and a lower surface 870 of the fixing portion 850 for the detection unit).

As illustrated in FIG. 8, the detection unit 600 (the plate metal 610 and the printed wired board 630) overlaps with the displacement unit 500 (the pinion 530, the first rack 512, and the first rack portion 510) in the D direction being a stacking direction of the sheet P.

Figure 9:
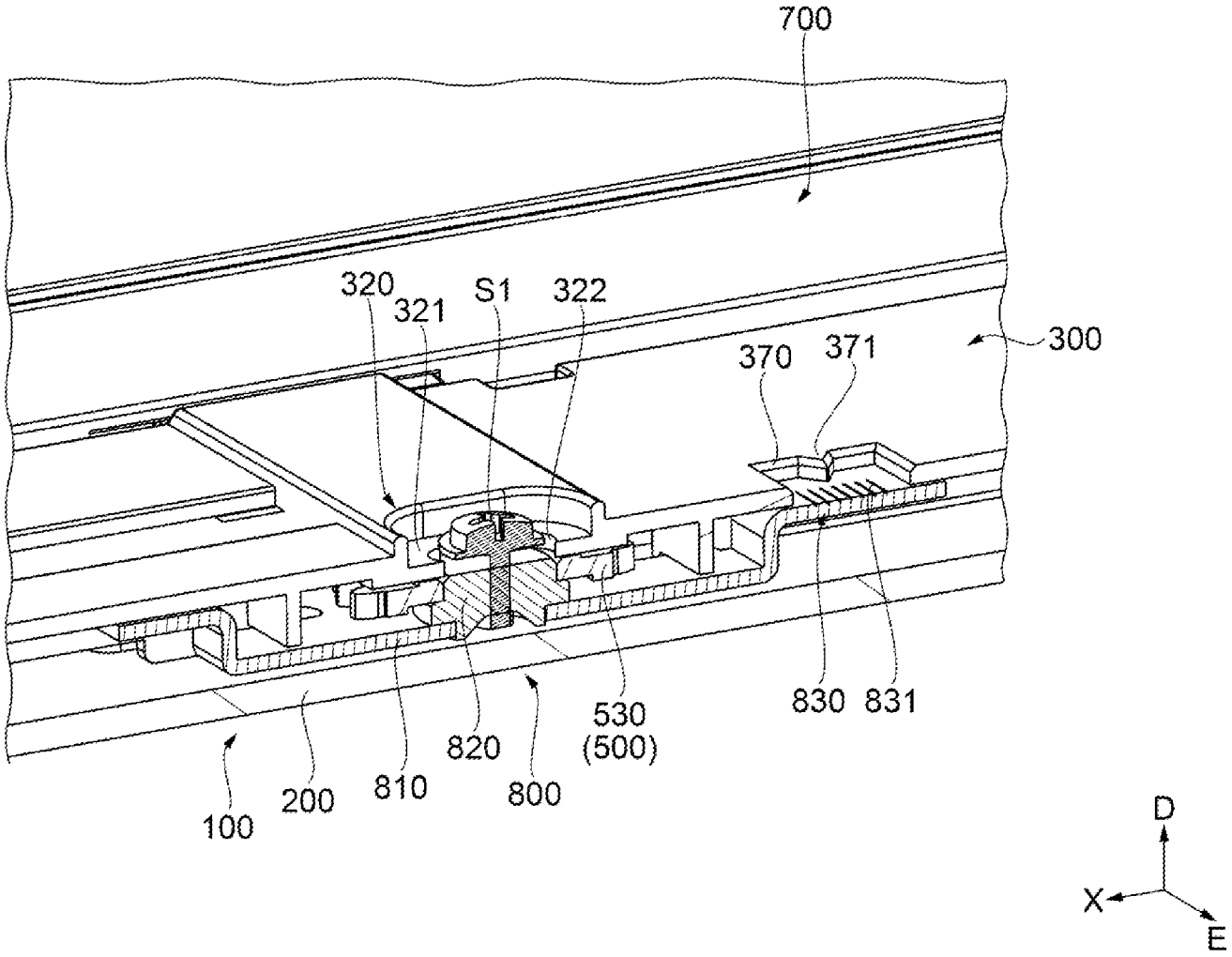
FIG. 9 is a perspective view illustrating a state taken along an X-D plane with a pinion as a center.

FIG. 9 is a perspective view illustrating a state taken along the X-D plane with the pinion 530 as a center. With reference to FIG. 9, description is made on a position adjustment method in which the adjustment unit 800 adjusts positions of the edge guide 400 being a regulation unit, the displacement unit 500, and the detection unit 600. Note that FIG. 9 does not illustrate the edge guide 400 and the detection unit 600.

As the position adjustment method, in the present exemplary embodiment, the placement unit 300 provided on the feeding tray 100 is regarded as a reference, and adjustment is performed by moving the adjustment unit 800 with respect to the placement unit 300. With this, basic positioning of the edge guide 400, the displacement unit 500, the detection unit 600, and also the adjustment unit 800 is performed. Note that it is assumed that the placement unit 300 is fixed to the tray main body 200 and that the position thereof on the side close to the main body unit 12 is adjusted.

In the position adjustment method, the adjustment unit 800 performs adjustment in the X direction in accordance with a deviation amount of the sheet position in the X direction on the side close to the main body unit 12. Specifically, the movement amount of the adjustment unit 800 is determined by a deviation amount of the sheet position in the X direction with respect to the position of the recording unit (the line head 40) on the side close to the main body unit 12. Thus, the adjustment unit 800 moves in accordance with the deviation amount.

Here, a fixing portion 321 is formed in a one-stage lower area of the screw hole portion 320 for fixing the adjustment unit. A hole portion 322 is formed in the fixing portion 321. The hole portion 322 has an elliptical shape having the X direction as a longitudinal direction and the E direction as a transverse direction. The screw S1 is inserted through the hole portion 322.

Furthermore, when the adjustment unit 800 moves, threading between the screw S1 and the fixing pin 820 is loosened first, as illustrated in FIG. 9. With this, fixing of the fixing portion 321 sandwiched between the screw S1 and the fixing pin 820 is loosened.

With this, the screw S1 threaded with the fixing pin 820 can move in the X direction (the longitudinal direction of the hole portion 322). The screw S1 moves to the X direction, so that the adjustment unit 800 (the pinion holding portion 810 and the fixing portion 850 for the detection unit) moves in an interlocking manner. Note that, when the adjustment unit 800 moves, the protrusion portion 751 of the detection holding unit 700 engaged with the fixing cutout portion 860 of the adjustment unit 800 (the fixing portion 850 for the detection unit) moves in an interlocking manner. Therefore, when the screw S1 moves in the X direction, the detection holding unit 700 moves in an interlocking manner.

When the screw S1 moves in the X direction, the pinion holding portion 810 moves in the X direction in an interlocking manner. Thus, the pinion 530 held by the pinion holding portion 810 (the fixing pin 820) also moves in the X direction. With this operation, the first rack 512 and the second rack 522 that are meshed with the pinion 530 interlock with each other, and move in the X direction. Thus, the first edge guide 410 and the second edge guide 450 also follows and moves in the X direction.

Note that, as illustrated in FIG. 9, a scale portion 830 that indicates a moving amount at the time of moving is formed on the pinion holding portion 810 by protruding one stage. In the present exemplary embodiment, the upper surface of the scale portion 830 has a plurality of scales 831 that are formed as streaks along the E direction and formed at an interval of 1 mm in the X direction.

A scale window portion 370 through which the scale portion 830 is exposed is formed in the placement unit 300 above the scale portion 830. An indication portion 371 is formed on the center position of the scale window portion 370 in the X direction. The indication portion 371 extends in a triangular shape indicating a position of the scales 831 at the time of adjustment, by pointing to the center of the scale window portion 370.

For example, description is made on a case in which the adjustment unit 800 moves in the +X direction by 2 mm. In this case, the scales 831 exposed through the scale window portion 370 and the indication portion 371 are viewed in the +D direction. Then, the scales 831 move in the +X direction by 2 mm (2 scales) in consideration of, for example, a difference between a position of the scale portion 830, which is currently indicated by the indication portion 371, and a position of the scales 831 (streaks). With the adjustment method described above, the adjustment unit 800 is capable of adjusting positions of the edge guide 400, the displacement unit 500, and the detection unit 600.

Note that, after the adjustment unit 800 completes position adjustment, the screw S1 is threaded with the fixing pin 820 again. With this, the fixing portion 321 positioned between the fixing pin 820 and the screw S1 is sandwiched in the transverse direction, and is fixed. With this, the edge guide 400, the displacement unit 500, and the detection unit 600 for which the adjustment unit 800 completes adjustment can be fixed with respect to the placement unit 300 being a reference.

Figure 10:
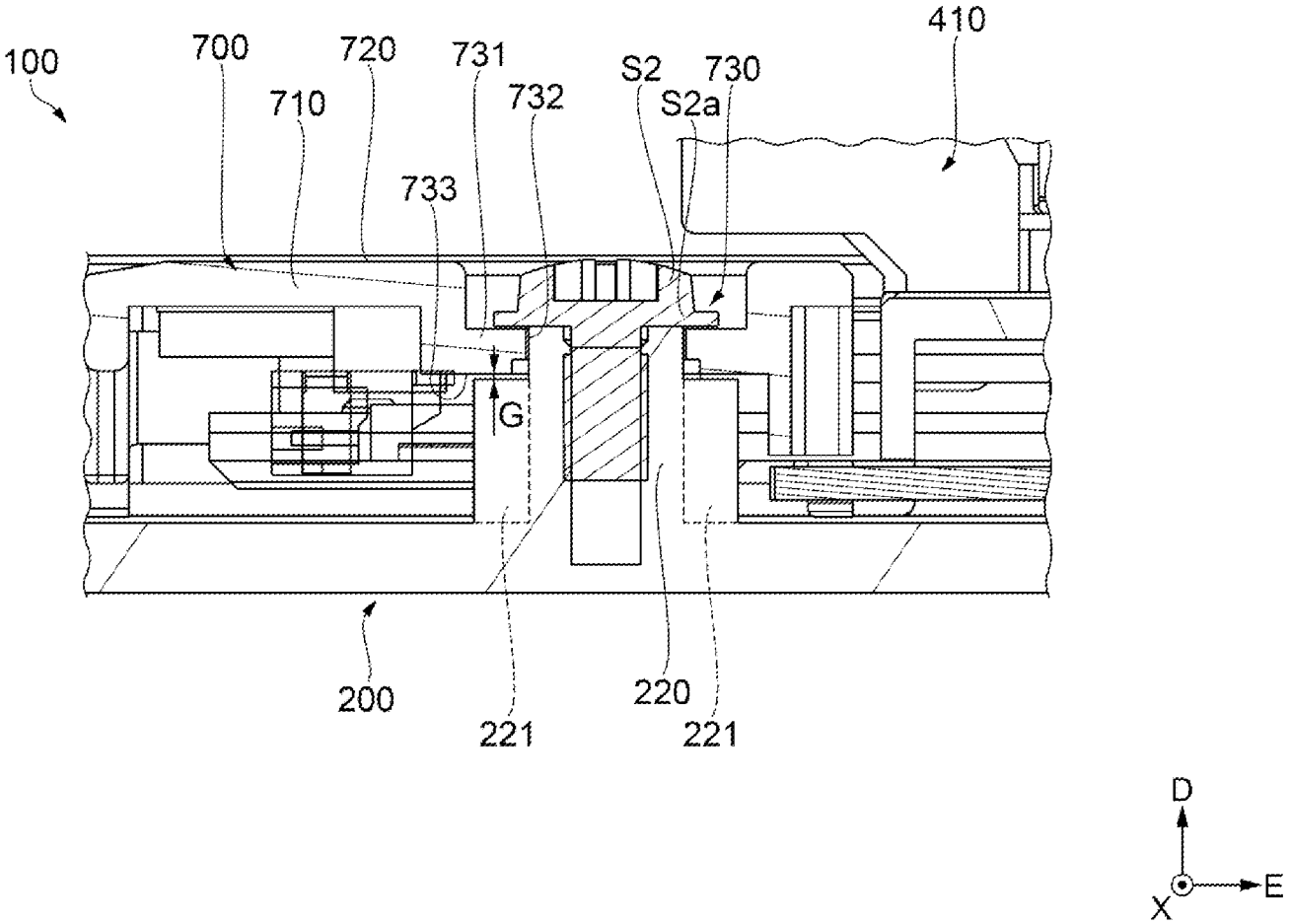
FIG. 10 is a cross-sectional view illustrating the detection holding unit, the tray main body, and a screw.

FIG. 10 is a cross-sectional view illustrating the detection holding unit 700 (the screw hole portion 730 for holding the detection unit), the tray main body 200 (the dowel 220 for holding the detection unit), and the screw S2. FIG. 10 is a cross-sectional view taken along the line B-B in FIG. 4.

With reference to FIG. 10, description is made on holding of the detection holding unit 700 with the screw S2.

In the present exemplary embodiment, the screw hole portion 730 for holding the detection unit (specifically, the holding portion 731 described later) of the detection holding unit 700 is not completely fixed to the dowel 220 for holding the detection unit with the screw S2. In the present exemplary embodiment, the screw S2 is threaded with the dowel 220 for holding the detection unit for the purpose of preventing the detection holding unit 700 from floating and the purpose of holding the position.

The holding portion 731 is formed in a one-stage lower area of the screw hole portion 730 for holding the detection unit, which is formed in the detection holding unit 700. A hole portion 732 is formed in the holding portion 731. The hole portion 732 has an elliptical shape having the X direction as a longitudinal direction and the E direction as a transverse direction. The screw S2 is inserted through the hole portion 732. A holding rib 221 is formed at the dowel 220 for holding the detection unit, at a one-stage lower position from the top surface of the dowel 220 for holding the detection unit. The holding rib 221 is in contact with the side surfaces of the dowel 220 for holding the detection unit in the +E direction and the −E direction, and extends in the X direction.

The length of the holding rib 221 in the X direction is formed to be longer than the diameter of the hole portion 732 in the transverse direction. The position of the top surface of the dowel 220 for holding the detection unit substantially matches with the position of the upper surface of the holding portion 731. Furthermore, the position of the top surface of the holding rib 221 is formed below a lower surface 733 of the holding portion 731. Therefore, when the screw S2 is inserted through the hole portion 732 of the holding portion 731 and is threaded with the dowel 220 for holding the detection unit, and a head portion S2*a* of the screw S2 abuts against the top surface of the dowel 220 for holding the detection unit, a gap G is formed between the lower surface 733 of the holding portion 731 and the top surface of the holding rib 221.

The upper surface of the holding portion 731 in the transverse direction of the hole portion 732 abuts against the head portion S2*a* of the screw S2, and hence is regulated from moving upward. With this, the detection holding unit 700 can be prevented from floating upward.

The gap G is formed, and hence the holding portion 731 is not fixed by the screw S2. Thus, the detection holding unit 700 is capable of moving in the X direction being the longitudinal direction of the hole portion 732. Note that the other screw hole portion 730 for holding the detection unit is configured similarly. Therefore, when the screw S1 moves in the X direction at the time of positioning, the detection holding unit 700 moves in the X direction in an interlocking manner. Note that, when the detection holding unit 700 is pressed from above, a downward movement amount can be suppressed by setting the gap G to be small.

Note that, in the present exemplary embodiment, threading between the screw S2 of the screw hole portion 730 for holding the detection unit and the dowel 220 for holding the detection unit is released, so that the detection holding unit 700 can be removed upward from the side close to the placement surface 720. With this, the detection unit 600 (the printed wired board 630) and the detection holding unit 700 are integrally formed, and are detachably provided to the placement unit 300 from the side close to the placement surface 720 being the first surface side.

Figure 11:
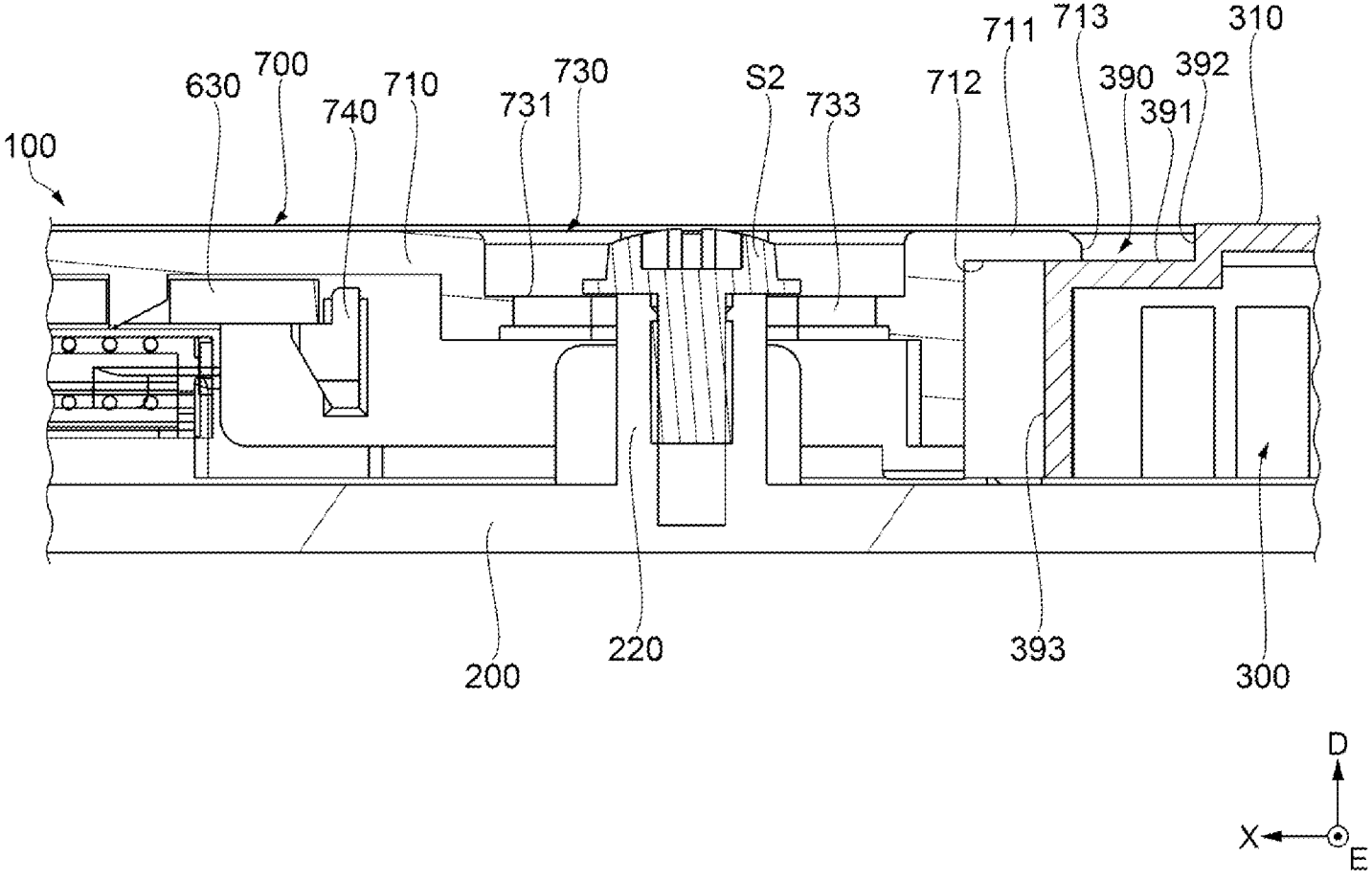
FIG. 11 a cross-sectional view illustrating an end of the detection holding unit in a −X direction.

FIG. 11 is a cross-sectional view illustrating an end 711 of the detection holding unit 700 (the holding unit main body 710) in the −X direction. FIG. 11 is a cross-sectional view taken along the line C-C in FIG. 4.

With reference to FIG. 11, description is made on a prevention mechanism of a planar gap between the end 711 of the holding unit main body 710 in the −X direction and the placement unit 300. Note that a prevention mechanism of a planar gap between the end of the holding unit main body 710 in the +X direction and the placement unit 300 is similar to the prevention mechanism of the planar gap between the end 711 of the holding unit main body 710 in the −X direction and the placement unit 300. Thus, description therefor is omitted.

As described above, the detection holding unit 700 in the present exemplary embodiment moves in the X direction in interlocking with movement of the adjustment unit 800. As illustrated in FIG. 11, a reception portion 390 is formed at the placement unit 300. The reception portion 390 receives the end 711 of the holding unit main body 710 in the −X direction. The reception portion 390 is recessed one stage from the placement surface 310, and a lower surface 712 of the end 711 and a reception surface 391 of the reception portion 390 are formed at such positions that a gap is formed therebetween in a cross-sectional manner.

The reception portion 390 is formed to have a width dimension of the opening portion 340 for the detection unit in the E direction, in a planar manner. The reception portion 390 is formed to have, in the X direction, such a length that an end surface 713 of the end 711 does not abut against an end surface 392 of the reception portion 390 in the −X direction (in other words, such a length that a gap is formed) when the end 711 moves in the −X direction, in a planar manner. The reception portion 390 is formed to have, in the X direction, such a length that the reception surface 391 of the reception portion 390 and the lower surface 712 of the end 711 overlap with each other in plan view, when the end 711 moves in the +X direction, in a planar manner. Note that the configuration described above is also applied similarly in the +X direction of the holding unit main body 710.

With the configuration described above, when the detection holding unit 700 (the holding unit main body 710) moves in the X direction, the lower surface 712 of the holding unit main body 710 (the end 711) slides on the reception surface 391 of the reception portion 390, and moves. In this case, when the detection holding unit 700 (the holding unit main body 710) moves by a maximum amount within a movement range thereof, both the ends 711 of the holding unit main body 710 in the X direction also overlap with the reception portion 390 of the placement unit 300 in the X direction (the width direction of the sheet P) as viewed from above. Thus, a planar gap is not formed.

In other words, the placement unit 300 has the reception portion 390 being a region overlapping with the end 711 of the holding unit main body 710 in the width direction of the sheet P in plan view from the +D direction. Thus, even when the detection holding unit 700 moves, a planar gap is not formed.

Figure 12:
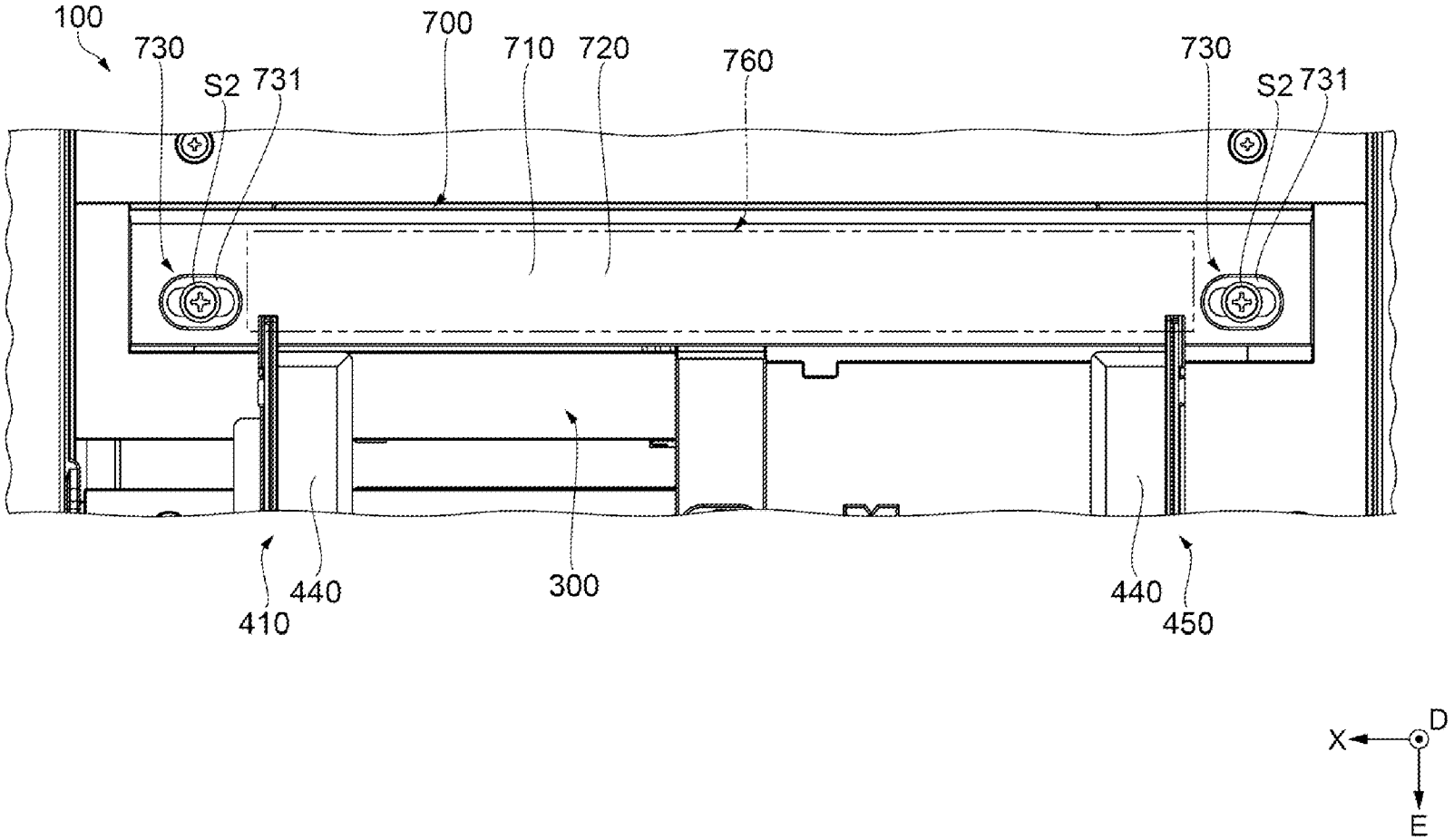
FIG. 12 is a plan view illustrating a marking portion of the detection holding unit.

FIG. 12 is a plan view illustrating the marking portion 760 of the detection holding unit 700.

With reference to FIG. 12, the marking portion 760 provided to the detection holding unit 700 is described.

The marking portion 760 in the present exemplary embodiment is formed on the placement surface 720 being the first surface of the holding unit main body 710 of the detection holding unit 700. In the present exemplary embodiment, as indicated with the two-dot chain line in FIG. 12, the marking portion 760 is formed in a region surrounded by the two screw hole portions 730 for holding the detection unit, which are formed in the X direction.

Note that the marking portion 760 is a portion indicating a sheet edge surface position according to various sizes of the sheet P in the width direction and a position of the edge guide 400. The marking method may include engraving, printing, etching, and the like on the placement surface 720. The marking method may include affixing of a printed sheet.

According to the present exemplary embodiment, the following effects can be exerted.

The feeding tray 100 being the medium placing device according to the present exemplary embodiment includes the placement unit 300 on which the medium (the sheet P) is placed, the edge guide 400 being a regulation unit that regulates movement of the sheet P, which is placed on the placement unit 300, in the first direction (the width direction of the sheet P), and the displacement unit 500 that holds the edge guide 400 in a movable manner in the width direction of the sheet P. The feeding tray 100 includes the detection unit 600 that detects a position of the edge guide 400 in the width direction of the sheet P and the adjustment unit 800 capable of adjusting positions of the edge guide 400, the displacement unit 500, and the detection unit 600 in the width direction of the sheet P. Furthermore, the edge guide 400 includes the first regulation member (the first edge guide 410) that regulates the edge surface of the sheet P in the +X direction, which is the first edge of the sheet P in the width direction, and the second regulation member (the second edge guide 450) that regulates the edge surface of the sheet P in the −X direction, which is the second edge of the sheet P in the width direction and is opposite to the first edge. The displacement unit 500 is capable of moving the first edge guide 410 and the second edge guide 450 in the directions opposite to each other along the width direction of the sheet P. The detection unit 600 is provided between the placement unit 300 and the adjustment unit 800.

With this configuration, the detection unit 600 is provided between the placement unit 300 and the adjustment unit 800, specifically, between the placement surface 310 of the placement unit 300 and the lower surface 870 of the adjustment unit 800 (the fixing portion 850 for the detection unit), and hence the dimension of the feeding tray 100 in the stacking direction of the sheet P (the height direction) can be suppressed.

In the feeding tray 100 according to the present exemplary embodiment, the detection unit 600 (the plate metal 610 and the printed wired board 630) overlaps with the displacement unit 500 (the pinion 530, the first rack 512, and the first rack portion 510) in the D direction being the stacking direction of the sheet P.

With this configuration, the dimension of the feeding tray 100 in the stacking direction can be suppressed.

In the feeding tray 100 according to the present exemplary embodiment, the detection unit 600 includes the plate metal 610 being the detected portion that is provided to the edge guide 400 being the regulation unit and interlocks with the edge guide 400 and the printed wired board 630 being the position detection portion that detects a position of the plate metal 610 in the width direction of the sheet P.

With this configuration, the position detection portion (the printed wired board 630) detects a position of the detected portion (the plate metal 610) interlocking with the regulation unit (the edge guide 400). Thus, a position of the edge guide 400 can be detected with a simple configuration. The detection unit 600 performs detection with a combination of the position detection portion (the printed wired board 630) and the detected portion (the plate metal 610) interlocking with the edge guide 400. Thus, various detection methods may be used.

In the feeding tray 100 according to the present exemplary embodiment, the detection unit 600 detects a position of the regulation unit (the edge guide 400) by bringing the detected portion (the plate metal 610) into contact with different positions of the position detection portion (the printed wired board 630).

With this configuration, the detection unit 600 functions as a contact-type sensor in which the detected portion (the plate metal 610) is brought into contact with different positions of the position detection portion (the printed wired board 630) thereby detecting a position of the detected portion (the plate metal 610). With this, an interval between the detected portion (the plate metal 610) and the position detection portion (the printed wired board 630) can be reduced, and the dimension in the stacking direction can further be reduced.

The feeding tray 100 according to the present exemplary embodiment includes the detection holding unit 700 that holds the detection unit 600 and has the placement surface 720 being the first surface. Furthermore, the placement surface 720 forms a placement surface on which the sheet P is placed, together with the placement surface 310 of the placement unit 300.

With this configuration, the placement surface 720 being the first surface that holds the detection unit 600 (the printed wired board 630) is used as part of the placement surface together with the placement surface 310. Thus, the dimension in the stacking direction can be suppressed by the thickness of the first surface (the placement surface 720).

In the feeding tray 100 according to the present exemplary embodiment, the detection holding unit 700 includes the marking portion 760 on the placement surface 720 being the first surface.

With this configuration, the detection holding unit 700 includes the mark on the first surface forming the placement surface 720, and the mark indicates a sheet edge surface position corresponding to various sizes of the sheet P in the width direction and a position of the regulation unit (the edge guide 400), for example. Thus, when the sheet P is placed, the mark can be used as a reference for moving the edge guide 400. When the adjustment unit 800 adjusts the position of the edge guide 400, the detection holding unit 700 has a configuration of moving together with the edge guide 400, and hence deviation of the position of the edge guide 400 from the position of the mark can be suppressed.

In the feeding tray 100 according to the present exemplary embodiment, the detection unit 600 (the printed wired board 630) and the detection holding unit 700 are integrally formed, and are detachably provided to the placement unit 300 from the side close to the placement surface 720 being the first surface.

With this configuration, for example, when the detection unit 600 (the printed wired board 630) and the detection holding unit 700 are assembled to or removed from the feeding tray 100, the assemble and removal can be performed from the side close to the placement surface 720. Thus, assemble and removal workability can be improved. With this configuration, assembly workability and maintenance workability are improved.

In the feeding tray 100 according to the present exemplary embodiment, the adjustment unit 800 (the fixing cutout portion 860) is engaged with the detection holding unit 700 (the protrusion portion 751), and the detection holding unit 700 interlocks with the operation of the adjustment unit 800.

With this configuration, the adjustment unit 800 interlocks with the detection holding unit 700, and an operation of the adjustment unit 800 and the detection holding unit 700 are in an interlocking relationship. With this simple configuration, when the position of the regulation unit (the edge guide 400) is adjusted, the position of the detection unit 600 (the printed wired board 630) can be adjusted by moving the detection unit 600 (the printed wired board 630) held by the detection holding unit 700. In particular, in a configuration in which the detection unit 600 (the printed wired board 630) is detachably assembled, replacement of the detection unit 600 (the printed wired board 630) is more facilitated than a case in which the adjustment unit 800 and the detection holding unit 700 are integrally formed, instead of engaging the both units with each other.

In the feeding tray 100 according to the present exemplary embodiment, the detection holding unit 700 (the end 711 of the holding unit main body 710) has the region (the reception portion 390) that overlaps with the placement unit 300 in the first direction (the width direction of the sheet P) as viewed in top view (in plan view from the +D direction). Note that, when the adjustment unit 800 adjusts the position of the regulation unit (the edge guide 400), the detection holding unit 700 that holds the detection unit 600 (the printed wired board 630) also moves. Thus, it is required to secure the movement range of the detection holding unit 700 in the placement unit 300. Thus, with the above-mentioned configuration, within the movement range of the detection holding unit 700, the end 711 of the detection holding unit 700 and the reception portion 390 of the placement unit 300 overlap with each other in the first direction. With this, even when the detection holding unit 700 moves, a planar gap in the first direction can be prevented. Thus, a foreign matter can be prevented from entering the feeding tray 100, and designability of the feeding tray 100 can be improved.

The recording apparatus 10 according to the present exemplary embodiment includes the feeding tray 100 described above and a printing unit (the line head 40) that performs recording onto the sheet P placed on the feeding tray 100.

With this configuration, the recording apparatus 10 includes the feeding tray 100 in which the dimension in the stacking direction is suppressed. Thus, the recording apparatus can be reduced in size.

In the recording apparatus 10 according to the present exemplary embodiment, the feeding tray 100 is displaceable between the used state in which the sheet P is able to be stacked and the accommodated state in which the sheet P is not able to be stacked.

With this configuration, the feeding tray 100 is displaceable between the used state and the accommodated state, and hence the recording apparatus 10 can be reduced in size during the accommodated state in which the feeding tray 100 is not used. In particular, when, in the recording apparatus 10, the feeding tray 100 is provided to a side surface as a multi-purpose (MP) tray, that is, a so-called manual feed tray, the dimension of the recording apparatus 10 in the side surface direction can be suppressed particularly at the time of accommodation.

2. First Modification Example

In the present exemplary embodiment, the entirety of the detection unit 600 (the plate metal 610 and the printed wired board 630) substantially overlaps with the displacement unit 500 (the pinion 530, the first rack 512, and the first rack portion 510) in the D direction being the stacking direction of the sheet P. However, the present exemplary embodiment is not limited thereto, and both the units may partially overlap with each other in the stacking direction.

3. Second Modification Example

In the present exemplary embodiment, the feeding tray 100 is described as one example of a multi-purpose (MP) tray, that is, a so-called manual feed tray. However, the present exemplary embodiment is not limited thereto, and the feeding tray 100 is applicable to a sheet cassette having a function similar to that of the sheet cassette 16 in the present exemplary embodiment, a document tray having an automatic document feeding (ADF) function, and the like.

4. Third Modification Example

In the present exemplary embodiment, when the detection unit 600 detects a sheet size, the circuit patterns formed on the printed wired board 630 is short-circuited with the plate metal 610, and the sheet size is detected based on a combination of the circuit patterns at the position. However, the present exemplary embodiment is not limited thereto. A slide volume or the like may be used, and a sheet size may be detected based on change in resistance value obtained by moving a moving element or the like.

5. Fourth Modification Example

In the present exemplary embodiment, in the detection unit 600, the plate metal 610 is used as a contact type sensor that is brought into contact with the circuit patterns formed on the printed wired board 630. However, the present exemplary embodiment is not limited thereto. A non-contact type sensor, for example, an optical sensor may be used, and detection may be performed based on a difference in reflectivity, transmission/non-transmission of light, or the like.

6. Fifth Modification Example

In the present exemplary embodiment, as the detection unit 600, there is adopted a configuration in which the plate metal 610 is used and brought into contact with the circuit patterns formed on the printed wired board 630 (short-circuit). However, the present exemplary embodiment is not limited thereto, and there may be used a mechanical switch that turns a switch to an on state or an off state when receiving a force from a part formed correspondingly to a sheet size.

7. Sixth Modification Example

In the present exemplary embodiment, the detection unit 600 detects a sheet size through use of the plate metal 610 interlocking with an operation of the first edge guide 410. However, the present exemplary embodiment is not limited thereto, and the detection unit 600 may interlock with an operation of the second edge guide 450 instead of an operation of the first edge guide 410. A detection unit that interlocks with each of the first edge guide 410 and the second edge guide 450 may be used so as to detect a sheet size.

What is claimed is:

1. A medium placing device comprising:
a base part;
a placement surface at which a medium is placed;
a regulation unit configured to regulate a movement of the medium placed on the placement surface in a first direction;
a rack pinion mechanism configured to hold the regulation unit in a movable manner in the first direction;
a detection unit configured to detect a position of the regulation unit in the first direction; and
an adjustment unit configured to:
adjust positions of the regulation unit, the rack pinion mechanism, and the detection unit in the first direction; and
move the regulation unit, the rack pinion mechanism, and the detection unit in an interlocking manner in a same direction along the first direction, wherein
the regulation unit includes
a first regulation member configured to regulate a first edge of the medium in the first direction, and
a second regulation member configured to regulate a second edge of the medium in the first direction, the second edge being opposite to the first edge,
the rack pinion mechanism is configured to move the first regulation member and the second regulation member in directions opposite to each other along the first direction,
the detection unit is provided between the placement surface and the adjustment unit,
the adjustment unit is arranged on the base part,
the rack pinion mechanism is configured to move relative to the base part,
the placement surface is connected to the base part via the adjustment unit, and
the placement surface is configured to move relative to the base part.

2. The medium placing device according to claim 1, wherein at least a part of the detection unit overlaps with the rack pinion mechanism in a stacking direction of the medium.

3. The medium placing device according to claim 1, wherein the detection unit includes:
a detected portion being provided to the regulation unit, wherein the detected portion is configured to interlock with the regulation unit; and
a position detection portion configured to detect a position of the detected portion in the first direction.

4. The medium placing device according to claim 3, wherein
the detection unit is configured to detect the position of the regulation unit by the detected portion being brought into contact with a different part of the position detection portion.

5. The medium placing device according to claim 1, comprising: a detection holding unit having a first surface, wherein
the detection holding unit is configured to hold the detection unit, and
the first surface forms the placement surface at which the medium is placed.

6. The medium placing device according to claim 5, wherein the detection holding unit includes a marking portion as a reference for moving the regulation unit at the first surface.

7. The medium placing device according to claim 6, wherein
the detection unit and the detection holding unit are integrally formed, and are detachably provided to the placement surface from a direction in which the first surface is located.

8. The medium placing device according to claim 6, wherein
the adjustment unit is engaged with the detection holding unit, and
the detection holding unit interlocks with an operation of the adjustment unit.

9. The medium placing device according to claim 6, wherein
the marking portion indicates a medium edge surface position according to various sizes of the medium in a width direction and a position of the edge guide.

10. The medium placing device according to claim 5, wherein the detection holding unit has a region that overlaps with the placement surface in the first direction as viewed in a top view.

11. The medium placing device according to claim 1, wherein
the adjustment unit is fixed to the placement surface with a fixing member, and
the fixing member is configured to switch between a state in which the adjustment unit is movable in the first direction and a state in which the adjustment unit is not movable.

12. A recording apparatus comprising:
the medium placing device according to claim 1; and
a recording unit configured to perform recording onto the medium placed at the medium placing device.

13. The recording apparatus according to claim 12, wherein
the medium placing device is configured to be displaced between a used state in which the medium is stackable and an accommodated state in which the medium is not stackable.

14. A medium placing device comprising:

a placement surface at which a medium is placed;

a regulation unit configured to regulate a movement of the medium placed on the placement surface in a first direction;

a rack pinion mechanism configured to hold the regulation unit in a movable manner in the first direction;

a detection unit configured to detect a position of the regulation unit in the first direction;

a detection holding unit configured to hold the detection unit; and an adjustment unit configured to adjust positions of the regulation unit, the rack pinion mechanism, and the detection unit in the first direction, wherein a fixing cutout portion of the adjustment unit is engaged with a protrusion portion of the detection holding unit such that the detection holding unit interlocks with the adjustment unit, and the regulation unit includes a first regulation member configured to regulate a first edge of the medium in the first direction, and a second regulation member configured to regulate a second edge of the medium in the first direction, the second edge being opposite to the first edge, the rack pinion mechanism is configured to move the first regulation member and the second regulation member in directions opposite to each other along the first direction, and the detection unit is provided between the placement surface and the adjustment unit.

15. A medium placing device comprising:

a base part;

a placement surface at which a medium is placed;

a regulation unit configured to regulate a movement of the medium placed on the placement surface in a first direction;

a rack pinion mechanism configured to hold the regulation unit in a movable manner in the first direction, wherein the rack pinion mechanism includes a flat plate portion having a flat plate-like shape;

a detection unit configured to detect a position of the regulation unit in the first direction, wherein the detection unit includes a plate metal holding portion, and the plate metal holding portion is fixed to the flat plate portion; and an adjustment unit configured to adjust positions of the regulation unit, the rack pinion mechanism, and the detection unit in the first direction, wherein the regulation unit includes a first regulation member configured to regulate a first edge of the medium in the first direction, and a second regulation member configured to regulate a second edge of the medium in the first direction, the second edge being opposite to the first edge, the rack pinion mechanism is configured to move the first regulation member and the second regulation member in directions opposite to each other along the first direction, the detection unit is provided between the placement surface and the adjustment unit, the adjustment unit is arranged on the base part, the rack pinion mechanism is configured to move relative to the base part, the placement surface is connected to the base part via the adjustment unit, and the placement surface is configured to move relative to the base part.

* * * * *